US011666112B2

(12) United States Patent
Rogers et al.

(10) Patent No.: US 11,666,112 B2
(45) Date of Patent: Jun. 6, 2023

(54) HEADBORNE ATTACHMENT PLATFORM INCLUDING SYSTEM, DEVICES AND METHODS

(71) Applicant: Final Forge, LLC, Plymouth, MA (US)

(72) Inventors: David Rogers, Chatham, MA (US); Mike Aaskov, Kennebunkport, ME (US)

(73) Assignee: Final Forge, LLC, Plymouth, MA (US)

( * ) Notice: Subject to any disclaimer, the term of this patent is extended or adjusted under 35 U.S.C. 154(b) by 267 days.

(21) Appl. No.: 17/105,750

(22) Filed: Nov. 27, 2020

(65) Prior Publication Data

US 2021/0153594 A1 May 27, 2021

Related U.S. Application Data

(60) Provisional application No. 62/941,383, filed on Nov. 27, 2019.

(51) Int. Cl.
*A42B 3/14* (2006.01)
*A42B 3/08* (2006.01)

(52) U.S. Cl.
CPC ..... *A42B 3/145* (2013.01); *A42B 3/085* (2013.01); *A42B 3/142* (2013.01)

(58) Field of Classification Search
CPC ..... A42B 3/085; A42B 3/142; A42B 3/145
See application file for complete search history.

(56) References Cited

U.S. PATENT DOCUMENTS

| | | | |
|---|---|---|---|
| 2,763,863 | A | 9/1956 | Bowers, Sr. |
| 2,967,304 | A | 1/1961 | Austin |
| 3,253,281 | A | 5/1966 | Benner |
| 3,510,879 | A | 5/1970 | Webb |
| 3,992,720 | A | 11/1976 | Nicolinas |
| 4,354,283 | A | 10/1982 | Gooding |
| 4,888,831 | A | 12/1989 | Oleson |
| 5,337,420 | A | 8/1994 | Haysom et al. |

(Continued)

FOREIGN PATENT DOCUMENTS

| | | | |
|---|---|---|---|
| CA | 2017401 | A1 | 3/1991 |
| CA | 2611265 | A1 | 5/2009 |

(Continued)

*Primary Examiner* — Katherine M Moran
(74) *Attorney, Agent, or Firm* — Mark Malek; Jonathan Staudt; Widerman Malek, PL

(57) ABSTRACT

A headborne attachment platform includes multiple rigid plates and straps of connecting material connecting the rigid plates in an assembly at independently selectable and pre-set distances apart from each other. The assembly of rigid plates is shaped and connected to sit adjacent to, and surround, the bone regions of a wearer's skull, and define an overall headgear shape and contour. The straps are more flexible than the rigid plates in directions perpendicular to the thickness of the straps, and the straps are inelastic in a direction of a length thereof. A tightening mechanism is configured to adjust a circumference of a headband region, and the rigid plates have mounting features configured to mount an outer helmet shell and/or a headborne device. The rigid plates are sufficiently rigid to support and maintain their three-dimensional shape when subjected to forces exerted upon them by the outer helmet shell or headborne device.

20 Claims, 15 Drawing Sheets

(56) References Cited

U.S. PATENT DOCUMENTS

| | | | | |
|---|---|---|---|---|
| 5,572,749 | A | 11/1996 | Ogden | |
| 6,081,931 | A | 7/2000 | Burns et al. | |
| 8,348,448 | B2 | 1/2013 | Orozco et al. | |
| 8,505,121 | B2 | 8/2013 | Ahlgren et al. | |
| 8,661,570 | B2 | 3/2014 | Huh | |
| 8,745,770 | B2 | 6/2014 | Ahlgren et al. | |
| 8,875,318 | B2 | 11/2014 | Huh | |
| 9,066,551 | B2 | 6/2015 | Van Waes | |
| 9,066,552 | B2 | 6/2015 | Ahlgren et al. | |
| 9,179,729 | B2 | 11/2015 | Cotterman et al. | |
| 9,307,800 | B2 | 4/2016 | Andrews et al. | |
| 9,307,802 | B2 | 4/2016 | Hall | |
| 9,357,811 | B2 | 6/2016 | Chiang | |
| 9,480,293 | B2 | 11/2016 | Pfanner et al. | |
| 9,907,348 | B2 | 3/2018 | Huh | |
| 10,016,008 | B2 | 7/2018 | Sommers et al. | |
| 10,034,510 | B2 | 7/2018 | Patel et al. | |
| 10,064,443 | B2 | 9/2018 | Hall | |
| 10,098,403 | B2 | 10/2018 | Sommers et al. | |
| 10,299,530 | B2 | 5/2019 | Patel et al. | |
| 10,441,019 | B2 | 10/2019 | Huh | |
| 10,588,373 | B2 | 3/2020 | Staudinger | |
| 10,588,374 | B2 | 3/2020 | Maloney | |
| 11,357,279 | B2 * | 6/2022 | Cotterman | A42B 3/064 |
| 2001/0022005 | A1 | 9/2001 | Sasaki et al. | |
| 2006/0015986 | A1 | 1/2006 | Bielefeld | |
| 2009/0229041 | A1 | 9/2009 | Tufenkjian | |
| 2010/0024097 | A1 | 2/2010 | Saenim | |
| 2011/0289659 | A1 | 12/2011 | Lanez et al. | |
| 2013/0219596 | A1 | 8/2013 | Carvell | |
| 2015/0059066 | A1 | 3/2015 | Ketterer et al. | |
| 2017/0238643 | A1 | 8/2017 | Pereira et al. | |
| 2017/0245578 | A1 | 8/2017 | Xiong et al. | |
| 2017/0367430 | A1 | 12/2017 | Javorek et al. | |
| 2018/0042330 | A1 | 2/2018 | Wu | |
| 2018/0042774 | A1 | 2/2018 | Wu | |
| 2018/0271199 | A1 | 9/2018 | Szalkowski et al. | |
| 2019/0029355 | A1 | 1/2019 | Seo et al. | |
| 2019/0339736 | A1 * | 11/2019 | Chang | A42B 3/145 |
| 2020/0060544 | A1 | 2/2020 | Ross | |
| 2020/0383416 | A1 * | 12/2020 | Miller | A42B 3/145 |
| 2020/0390182 | A1 * | 12/2020 | Huh | A42B 3/142 |

FOREIGN PATENT DOCUMENTS

| | | | |
|---|---|---|---|
| CN | 109380799 | A | 2/2019 |
| EP | 2937005 | A2 | 10/2015 |
| FR | 2983688 | A1 | 6/2013 |
| FR | 3060972 | A1 | 6/2018 |
| GB | 894251 | A | 4/1962 |
| KR | 101150518 | B1 | 5/2012 |
| KR | 101674630 | B1 | 11/2016 |
| KR | 101961435 | B1 | 3/2019 |
| RU | 194740 | U1 | 12/2019 |
| WO | 2012071802 | A1 | 6/2012 |
| WO | 2017018118 | A1 | 6/2017 |

* cited by examiner

HEADBORNE ATTACHMENT PLATFORM INCLUDING SYSTEM, DEVICES AND METHODS

RELATED APPLICATIONS

This application claims the benefit under 35 U.S.C. § 119(e) of U.S. Provisional Patent Application Ser. No. 62/941,383 titled HEADBORNE ATTACHMENT PLATFORM INCLUDING SYSTEM, DEVICES AND METHODS filed on Nov. 27, 2019, the entire contents of each of which are incorporated herein by reference.

FIELD OF THE INVENTION

The present invention is related to the field of helmet suspension systems used inside protective helmets for military, sports, and commercial applications. Additionally, this invention is related to the field of headgear and headbands used to support eye protection visors, face shields, hearing protection earcups, respiratory protection masks. Additionally, this invention is related to the field of headgear and headbands used to support hold and support heads-up displays, night vision goggles, and communications headsets. This invention is also related to the field of headgear and headbands used to support hold and support illumination devices like flashlights as well as identification devices like blinking strobe lights and light reflective tape.

BACKGROUND OF THE INVENTION

The idea of wearing objects on the head dates back to the inception of clothing itself. Throughout the ages this has been done for many reasons including warmth, fashion, and protection from the elements (e.g. sun) or from injury. With the advent of helmets in the interest of protection, approaches for securing objects, or heavier objects, to the head and the idea of "head borne" equipment was developed. Surprisingly, even though methods for securing helmets to heads still rely on different sorts of padding and strapping to provide the same function they did years ago, subtle and unique changes in the designs have resulted in vast improvements to comfort, security, stability, convenience and level of protection they offer. In more recent times, the invention of headlamps and subsequent flashlights, night vision goggles and digital displays have all required the comfortable attachment and securing of equipment to the head for purposes other than for protection.

Headgear, that is not a helmet or helmet liner, has been developed and used for the attachment and securing of non-helmet protective devices to the head. For example, EP 2 299 857 B1 is not directed to a helmet or helmet liner, but rather describes a modular, multi-component system intended for the attachment of equipment for purposes other than protection including lights, night vision goggle mounts, and Identification Friend or Foe (IFF) devices. It is dependent upon being attached to a helmet to provide its function.

U.S. Pat. No. 9,560,893 B2 shows a headgear with a spring buffered occipital cradle that may be capable of supporting the attachment of face shields, hard hats, or welding shields. U.S. Pat. No. 4,741,054 discloses a headgear system for attaching and supporting a night vision goggle device to the head without use of a helmet. Other related patents include: U.S. Pat. No. 10,441,019 (2019) Huh; U.S. Pat. No. 8,348,448 (2013) Orozco; and US 2009/0229041 (2010) Tufenkjian;

However, none of these headgear devices is designed or intended for the purpose of securely attaching a protective helmet to the head. Since the combination of features and components are not intended for protection, use of a headgear device as a way of attaching a helmet to the head instead of using a liner made specific for use in a helmet would likely compromise or reduce the protective qualities of the resulting design.

Protective helmets commonly worn by military and law enforcement, firefighters, construction workers, and rock climbers are often comprised of an outer protective shell and an inner "suspension" type liner for securing the shell to the head. Suspension liner systems use conformal straps placed under tension to literally suspend the outer shell of the helmet with a gap apart from the head. These systems are lightweight, provide good air ventilation, and the ability to adjust to many different head shapes and sizes by changing the lengths of the straps. Other protective helmets used in sports like cycling, football, hockey, and skateboarding are often comprised of an outer protective shell and an inner "compression" type liner. Compression liner systems use foam, pads, or other shock absorbing medium that are conformal or pre-shaped to match the contour of the head. These systems generally provide better support, stability and comfort than suspension liners, but are also heavier and do not provide a comparable level of ventilation. Both versions usually include a lower strap assembly designed to engage a portion of the wearer's chin or neck of the nape as well as an element that wraps around the occipital lobe of the skull. A few helmets combine both suspension and compression type liner approaches.

U.S. Pat. Nos. 3,510,879 and 7,770,239, and 9,307,802 teach that a helmet suspension system is typically anchored within the helmet shell and provides a fit of the helmet shell to the wearer's head, while providing space between the inner part of the helmet and the wearer's head to disperse and absorb at least a portion of the force of an impact to the outer shell so the full force of the impact is not transferred directly to the wearer's head.

One of the key functional aspects of a suspension type of helmet liner, is that the elements that provide the fit, attachment, and security to suspend the helmet shell apart from the head (usually webbing or strapping made of plastic and woven fibers) is that they need to conform to the shape and/or size of the head under tension when the helmet is put on. Because their materials and arrangement are designed and intended to conform, it is the shape of the head itself that determines the shape of the suspension liner system when worn. While this may be efficient at matching many different head shapes and sizes with a custom-type fit, the suspension system has deficiencies when trying to comfortably support and stabilize a helmet being subjected to forces in multiple directions at once, especially when the force includes a rotational direction.

Historically, suspension type helmet liners have utilized a headband strap affixed to the outer helmet shell to extend circumferentially around from the front toward the back of the head. These suspension liners also use other straps affixed to the headband strap and/or the outer helmet shell to extend over the top of the head. The length of these straps is always less than the circumference of the outer helmet in the region of the head they occupy. So, when a helmet is put on and these straps are put under tension by the head, they become taught and, in doing so, suspend the outer helmet shell apart from the head. These straps are typically made from materials that are formed or cut in a flat shape, which is then bent into a three-dimensional shape to match the shape of a head when installed into a helmet shell. A critical aspect of these straps is that their material and design configuration must be such that they are flexible and conformable enough to change from a relatively flat shape to a curved three-dimensional shape when attached to the outer helmet shell and put against the head. In practice, this requirement for flexibility and conformability yields approaches that are unable to hold their shape without the outer helmet shell and/or head providing some level of support.

While the characteristics are what make suspension liners comfortable, ventilated, and lightweight, these same characteristics are what prevent them from being as stable and secure as compression type liners made from materials that are more rigid and less conformable. These characteristics also necessitate that the outer helmet shell is an integral part of the system for it to properly function.

Conversely, one of the key functional aspects of compression type helmet liners is that they are pre-shaped, sized, and/or made of a soft enough material (usually some type of foam/s) that can conform to the shape and/or size of the head under compression when the helmet is put on. The outer helmet shell is not suspended above the head, but rather sits on top of the liner material under compression instead. While compression type liners are good for supporting and stabilizing a helmet being subjected to forces in multiple directions at once, they have deficiencies when it comes to long term comfort since their pre-determined shape cannot be a perfect match for most heads, and the soft conformal foams that do take a custom shape are hotter, heavier, and can cause uncomfortable pressure points on the head over prolonged periods of use.

U.S. Pat. Nos. 9,516,910 and 6,883,181 teach of compression-type helmet liners that rely on attachment to an outer rigid helmet shell. The conjunction of the liner pads being affixed to helmet shell shape having the general shape of a head is what gives these compression liner systems a headform shape. Since the outer rigid helmet shell is a predetermined shape and size, and human heads come in many different shapes and sizes, the compression-type liner system is dependent upon the softness and thickness of the pads to compensate for the difference between the shape and size of the helmet shell and the shape and size of the helmet wearer's head.

Helmets that employ both suspension and compression style components and features in the same system typically have all the drawbacks of both approaches but without most of the benefits. This is because for a suspension liner to be effective it needs to be able to suspend the head apart from the outer helmet shell. Putting any compressive liner materials in the gap between the outer shell and the head adds weight and fills up the space that would have helped with ventilation. The main added benefit of combination systems is that in this scenario, the compressive liner materials can add more impact energy absorption performance than having nothing in the gap between the head and the outer shell.

While these helmet liners are intended for attaching and securing equipment to the head, in the case of helmets, the integral combination of design features, materials and devices for attachment to the outer helmet shell are so specific that the liners cannot function independently without having the helmet shell functioning as an integral component in the system. This means that the liners are not capable of being used separately for the support and attachment of other equipment to the head.

U.S. Pat. No. 9,179,729 describes a helmet liner system intended for use inside of a helmet shell and in some configurations in combination with compressible impact absorbing liner padding. Like helmet suspension liners, it relies on tension and flexing of materials to change shape to optimally fit the head, and when used in conjunction with compressible impact absorbing pads, claims improved comfort and protection. It utilizes front, central and rear support members spaced apart from each other with attachment features for securing the support members to the inside of a helmet. A tightening mechanism is provided on the rear support and includes a rotatable knob that winds up lace that pulls the support members together. This system requires a helmet to locate, secure and provide sufficient structure for it to function and does not describe any details related to independent function without being attached to a helmet. As such, there is no explanation of how the front, central, and rear support members are secured and supported in relation to one and other, or the characteristics of the features or regions of material connecting them. Further, there is no teaching of connecting regions of material being more flexible than the support members, or the regions of connecting material being inelastic and fixable in a direction of their length, or the assembly of rigid plates being shaped and connected by the regions of connecting material so they can be pre-set to sit adjacent to and surround portions of the frontal, temporal, parietal, and occipital bone regions of a skull of a wearer.

U.S. Pat. No. 10,588,374 is another helmet liner system intended for use inside of a helmet shell and in some configurations in combination with compressible impact absorbing liner padding. It claims the same fitting and comfort benefits as other hybrid approaches and relies of a construction of multiple frame pieces working together with a lace tightening mechanism to adjust the frames size and shape relative to each other. This system demonstrates how the inner and outer frames are longitudinally affixed to slide relative to each other and are secured by a lace tightening mechanism. As a result, all of the regions of adjustment in this system are dependent upon the tension of the lace tightening mechanism, and none of the regions of this system can be set independent of each other or at permanent, non-moveable positions. Further, there is no teaching of connecting regions of material being more flexible than the support members, or the regions of connecting material being inelastic and fixable in a direction of their length, or the assembly of rigid plates being shaped and connected by the regions of connecting material so they can be pre-set to sit adjacent to and surround portions of the frontal, temporal, parietal, and occipital bone regions of a skull of a wearer.

U.S. Pat. No. 10,299,530 describes a headgear intended for securing equipment like welding shields to the head, as well as other types of protective headborne devices like helmets. It utilizes a series of forehead, top, rear, and occipital straps that are pivotably coupled together on the sides of the device to provide a means for changing the system size and shape. However, due to the fact that the different straps can freely pivot relative to one and other, they are dependent upon attachment to a helmet to locate, provide sufficient structure to secure them with respect to one and other. Since these straps are not independently secured or supported in relation to one and other, when this system is not attached to a helmet, it is limited in its ability to stabilize other headborne devices like night vision goggles or heads-up displays. There aren't any regions of material interconnecting the straps on this device, so there is no teaching of connecting regions of material being more flexible than the support members, or the regions of connecting material being inelastic and fixable in a direction of their length, or the assembly of rigid plates being shaped and connected by the regions of connecting material so they can be pre-set to sit adjacent to and surround portions of the frontal, temporal, parietal, and occipital bone regions of a skull of a wearer.

Therefore, it would be desirable then to provide a system, device and method which would address the many shortcomings of the present conventional approaches.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the foregoing in mind, one of the many objects of the present invention is to provide a headborne attachment platform that protects the skull of a wearer and provides functionality independent of being attached to a helmet shell.

An embodiment of the present invention provides a headborne attachment platform to be worn on, and protect, a skull of a wearer, the headborne attachment platform including multiple rigid plates respectively contoured to sit adjacent to frontal, temporal, parietal, and occipital bone regions of the skull of the wearer, and straps of connecting material connecting the multiple rigid plates in an assembly, and having a thickness that is less than a width. A tightening mechanism is associated with the assembly of multiple rigid plates, and the assembly of multiple rigid plates is shaped and connected by the straps of connecting material to sit adjacent to, and surround, the portions of the frontal, temporal, parietal, and occipital bone regions of the skull of the wearer, and define an overall headgear shape and contour, and define a headband region around the skull. The straps of connecting material are more flexible than the rigid plates in directions perpendicular to the thickness of the straps, and the straps of connecting material are inelastic in a direction of a length thereof. The tightening mechanism is configured to adjust a circumference of the headband region of the assembly of multiple rigid plates, and the rigid plates have mounting features configured to mount at least one of an outer helmet shell and a headborne device. The rigid plates are independently and sufficiently rigid to support and maintain their three-dimensional shape when subjected to forces exerted upon them by the outer helmet shell or headborne device. The rigid plates include attachment features configured to provide for the attachment and detachment of the straps of connecting material so that the rigid plates are coupled together in the assembly and can be independently adjusted and set to selectable distances apart from each other using the straps of connecting material.

The assembly of multiple rigid plates is shaped and connected by the straps of connecting material such that the assembly can provide all of its functionality independent of being attached to a helmet shell.

Additionally, and/or alternatively, one of the multiple rigid plates is a frontal rigid plate with a central portion to sit adjacent to the frontal bone region of the skull and opposing side portions to sit adjacent the temporal bone regions of the skull; and wherein the central portion is relatively less flexible in directions toward and away from the skull than the side portions.

Additionally, and/or alternatively, the central portion of the frontal plate has a hemispherical shape that is less flexible in the direction that would increase or decrease a radius of its shape relative to rotation about an axis between basic and coronal planes of the skull than it is flexible in the direction that would increase or decrease the radius of its shape relative to rotation about an axis between the basic and midsagittal planes of the skull.

Additionally, and/or alternatively, the side portions of the frontal plate have flexibility inward and outward in a direction towards each other, the skull, and the midsagittal plane of a headform.

Additionally, and/or alternatively, one of the multiple rigid plates is a rear rigid plate to sit adjacent the parietal and occipital bone regions of the skull. The tightening mechanism includes an actuation mechanism carried by the rear rigid plate and configured to selectively cause the frontal rigid plate to move closer to the rear rigid plate in an area surrounding the headband region of the assembly, thereby adjusting the circumference, tension, and pressure exerted upon the skull by the headband region of the assembly for fitting purposes.

Additionally, and/or alternatively, the rear rigid plate includes features to provide for attachment of a chinstrap that extends around at least one of a neck area and chin area of the wearer with said chinstrap attachment features comprising at least one tool-less releasable buckle receiver adjacent the actuation mechanism.

Additionally, and/or alternatively, the actuation mechanism comprises a dial actuation mechanism and associated lace arranged through lace coupling features on the rear rigid plate that extend to the frontal rigid plate and surround the portions of the frontal, temporal, and parietal bone regions of the skull of the wearer; wherein the dial mechanism is configured to selectively shorten and lengthen the lace such that actuating the dial actuation mechanism adjusts portions of the rigid plates around the headband region to move closer to, and farther away from the skull thereby adjusting the circumference of the assembly of multiple rigid plates as well as an interior volume of space where the skull sits adjacent to the assembly of multiple rigid plates.

Additionally, and/or alternatively, the actuation mechanism comprises at least one of a worm gear mechanism, a rack and pinion mechanism, and a spool and lace winding mechanism.

Additionally, and/or alternatively, the rigid plates include padding attachment features to provide for attachment of comfort padding materials on a side that is adjacent to the skull of the wearer.

Additionally, and/or alternatively, at least one of the straps of connecting material is defined by a reduced width portion of one of the rigid plates, such that the connection material is inelastic and only flexible in the directions toward and away from the skull.

Another embodiment is directed to a headborne attachment platform to be worn on, and protect, a skull of a wearer, the headborne attachment platform including multiple rigid plates respectively contoured to sit adjacent to frontal, temporal, parietal, and occipital bone regions of the skull of the wearer, and straps of connecting material connecting the multiple rigid plates in an assembly, and having a thickness that is less than a width. A tightening mechanism is associated with the assembly of multiple rigid plates, and the assembly of multiple rigid plates is shaped and connected by the straps of connecting material to sit adjacent to, and surround, the portions of the frontal, temporal, parietal, and occipital bone regions of the skull of the wearer, and define an overall headgear shape and contour, and defining a headband region around the skull. The straps of connecting material are more flexible than the rigid plates in directions perpendicular to the thickness of the strap, and the straps of connecting material are inelastic in a direction of a length thereof. The tightening mechanism is configured to adjust a circumference of the headband region of the assembly of multiple rigid plates, and the rigid plates have mounting features configured to mount at least one of an outer helmet shell and a headborne device. The rigid plates are independently and sufficiently rigid to support and maintain their three-dimensional shape when subjected to forces exerted upon them by the outer helmet shell or headborne device, and the rigid plates include attachment features configured to provide for the attachment and detachment of the straps of connecting material so that the rigid plates are coupled together in the assembly and can be independently adjusted and set to selectable distances apart from each other using the straps of connecting material. One of the multiple rigid plates is a frontal rigid plate with a central portion to sit adjacent to the frontal bone region of the skull and opposing side portions to sit adjacent the temporal bone regions of the skull, with the central portion being relatively less flexible in directions toward and away from the skull than the side portions. One of the multiple rigid plates being a rear rigid plate to sit adjacent the parietal and occipital bone regions of the skull, and the tightening mechanism includes an actuation mechanism carried by the rear rigid plate and configured to selectively cause the frontal rigid plate to move closer to the rear rigid plate in an area surrounding the headband region of the assembly, thereby adjusting the circumference, tension, and pressure exerted upon the skull by the headband region of the assembly for fitting purposes. The actuation mechanism includes a dial actuation mechanism and associated lace arranged through lace coupling features on the rear rigid plate that extend to the frontal rigid plate and surround the portions of the frontal, temporal, and parietal bone regions of the skull of the wearer. The dial mechanism is configured to selectively shorten and lengthen the lace such that actuating the dial actuation mechanism adjusts regions of the rigid plates around the headband region to move closer to, and farther away from the skull thereby adjusting the circumference of the assembly of multiple rigid plates as well as an interior volume of space where the skull sits adjacent to the assembly of multiple rigid plates.

Additionally, and/or alternatively, the central portion of the frontal plate has a hemispherical shape that is less flexible in the direction that would increase or decrease a radius of its shape relative to rotation about an axis between basic and coronal planes of the skull than it is flexible in the direction that would increase or decrease the radius of its shape relative to rotation about an axis between the basic and midsagittal planes of the skull.

Additionally, and/or alternatively, the side portions of the frontal plate have flexibility inward and outward in a direction towards each other, the skull, and the midsagittal plane of a headform.

Additionally, and/or alternatively, the rear rigid plate includes features to provide for attachment of a chinstrap that extends around at least one of a neck area and chin area of the wearer with said chinstrap attachment features comprising at least one tool-less releasable buckle receiver located in the region of the rear rigid plate is adjacent to the occipital region of the skull.

Additionally, and/or alternatively, the rear rigid plate includes features to provide for attachment of a chinstrap that extends around at least one of a neck area and chin area of the wearer with said chinstrap attachment features comprising at least one tool-less releasable buckle receiver located in the region of the rear rigid plate adjacent the actuation mechanism.

Additionally, and/or alternatively, at least one of the straps of connecting material is defined by a reduced width portion of one of the rigid plates, such that the connection material is inelastic and only flexible in the directions toward and away from the skull.

Another embodiment is directed to a headborne attachment platform to be worn on, and protect, a skull of a wearer, the headborne attachment platform including multiple rigid plates respectively contoured to sit adjacent to bone regions of the skull of the wearer, and straps of connecting material connecting the multiple rigid plates in an assembly at independently selectable and pre-set distances apart from each other, the straps having a thickness that is less than a width. A tightening mechanism is associated with the assembly of multiple rigid plates, and the assembly of multiple rigid plates is shaped and connected by the straps of connecting material to sit adjacent to, and surround, the bone regions of the skull of the wearer, and define an overall headgear shape and contour, and define a headband region around the skull. The straps of connecting material are more flexible than the rigid plates in directions perpendicular to the thickness of the straps, and the straps of connecting material are inelastic in a direction of a length thereof. The tightening mechanism is configured to adjust a circumference of the headband region of the assembly of multiple rigid plates, and the rigid plates have mounting features configured to mount at least one of an outer helmet shell and a headborne device. The rigid plates are independently and sufficiently rigid to support and maintain their three-dimensional shape when subjected to forces exerted upon them by the outer helmet shell or headborne device.

Additionally, and/or alternatively, one of the multiple rigid plates is a frontal rigid plate with a central portion to sit adjacent to the frontal bone region of the skull and opposing side portions to sit adjacent the temporal bone region of the skull, and the central portion is relatively less flexible in directions toward and away from the skull than the side portions.

Additionally, and/or alternatively, one of the multiple rigid plates is a rear rigid plate to sit adjacent the parietal and occipital bone regions of the skull, and the tightening mechanism includes an actuation mechanism carried by the rear rigid plate and configured to selectively cause the frontal rigid plate to move closer to the rear rigid plate in an area surrounding the headband region of the assembly, thereby adjusting the circumference, tension, and pressure exerted upon the skull by the headband region of the assembly for fitting purposes.

Additionally, and/or alternatively, the rear rigid plate includes features to provide for attachment of a chinstrap that extends around at least one of a neck area and chin area of the wearer with said chinstrap attachment features comprising at least one tool-less releasable buckle receiver adjacent the actuation mechanism.

Additionally, and/or alternatively, the actuation mechanism comprises a dial actuation mechanism and associated lace arranged through lace coupling features on the rear rigid plate that extend to the frontal rigid plate and surround the portions of the frontal, temporal, and parietal bone regions of the skull of the wearer, and the dial mechanism is configured to selectively shorten and lengthen the lace such that actuating the dial actuation mechanism adjusts the regions of the rigid plates around the headband region to move closer to, and farther away from the skull thereby adjusting the circumference of the assembly of multiple rigid plates as well as an interior volume of space where the skull sits adjacent to the assembly of multiple rigid plates.

DETAILED DESCRIPTION OF THE INVENTION

Figure 1:
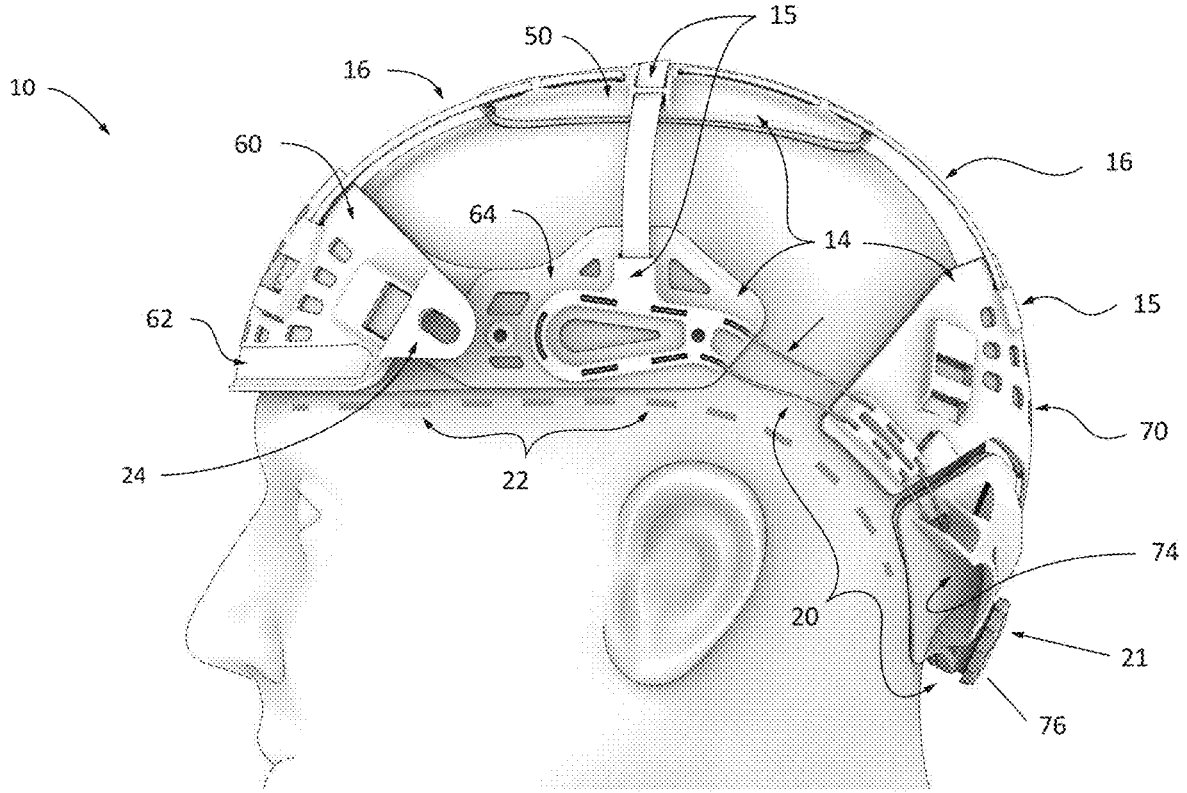
FIG. 1 is a side view illustrating a headborne attachment platform positioned on a skull of a wearer according to an embodiment of the invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the invention.

Before describing the present disclosure in detail, it is to be understood that this disclosure is not limited to parameters of the particularly exemplified systems, methods, apparatus, products, processes, and/or kits, which may, of course, vary. It is also to be understood that the terminology used herein is only for the purpose of describing particular embodiments of the present disclosure and is not necessarily, intended to limit the scope of the disclosure in any particular manner. Thus, while the present disclosure will be described in detail with reference to specific embodiments, features, aspects, configurations, etc., the descriptions are illustrative and are not to be construed as limiting the scope of the claimed invention. Various modifications can be made to the illustrated embodiments, features, aspects, configurations, etc. without departing from the spirit and scope of the invention as defined by the claims. Thus, while various aspects and embodiments have been disclosed herein, other aspects and embodiments are contemplated.

Unless defined otherwise, all technical and scientific terms used herein have the same meaning as commonly understood by one of ordinary skill in the art to which the present disclosure pertains. While several methods and materials similar or equivalent to those described herein can be used in the practice of the present disclosure, only certain exemplary materials and methods are described herein.

Various aspects of the present disclosure, including devices, systems, methods, etc., may be illustrated with reference to one or more exemplary embodiments or implementations. As used herein, the terms "embodiment," "alternative embodiment" and/or "exemplary implementation" means "serving as an example, instance, or illustration," and should not necessarily be construed as preferred or advantageous over other embodiments or implementations disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

It will be noted that, as used in this specification and the appended claims, the singular forms "a," "an" and "the" include plural referents unless the content clearly dictates otherwise. Thus, for example, reference to a "sensor" includes one, two, or more sensors.

As used throughout this application the words "can" and "may" are used in a permissive sense (i.e., meaning having the potential to), rather than the mandatory sense (i.e., meaning must). Additionally, the terms "including," "having," "involving," "containing," "characterized by," variants thereof (e.g., "includes," "has," and "involves," "contains," etc.), and similar terms as used herein, including the claims, shad be inclusive and/or open-ended, shall have the same meaning as the word "comprising" and variants thereof (e.g., "comprise" and "comprises"), and do not exclude additional, un-recited elements or method steps, illustratively.

Various aspects of the present disclosure can be illustrated by describing components that are coupled, attached, connected, and/or joined together. As used herein, the terms "coupled", "attached", "connected," and/or "joined" are used to indicate either a direct connection between two components or, where appropriate, an indirect connection to one another through intervening or intermediate components. In contrast, when a component is referred to as being "directly coupled", "directly attached", "directly connected," and/or "directly joined" to another component, no intervening elements are present or contemplated, Thus, as used herein, the terms "connection", "connected," and the like do not necessarily imply direct contact between the two or more elements. In addition, components that are coupled, attached, connected, and/or joined together are not necessarily (reversibly or permanently) secured to one another. For instance, coupling, attaching, connecting, and/or joining can comprise placing, positioning, and/or disposing the components together or otherwise adjacent in some implementations.

As used herein, directional and/or arbitrary terms, such as "top," "bottom," "front," "back," "left", "right," "up," "down," "upper," "lower," "inner," "outer," "internal," "external," "interior," "exterior," "proximal," "distal" and the like can be used solely to indicate relative directions and/or orientations and may not otherwise be intended to limit the scope of the disclosure, including the specification, invention, and/or claims.

Where possible, like numbering of elements have been used in various figures. In addition, similar elements and/or elements having similar functions may be designated by similar numbering. Furthermore, alternative configurations of a particular element may each include separate letters appended to the element number. Accordingly, an appended letter can be used to designate an alternative design, structure, function, implementation, and/or embodiment of an element or feature without an appended letter. Similarly, multiple instances of an element and or sub-elements of a parent element may each include separate letters appended to the element number. In each case, the element label may be used without an appended letter to generally refer to instances of the element or any one of the alternative elements. Element labels including an appended letter can be used to refer to a specific instance of the element or to distinguish or draw attention to multiple uses of the element. However, element labels including an appended letter are not meant to be limited to the specific and/or particular embodiment(s) in which they are illustrated. In other words, reference to a specific feature in relation to one embodiment should not be construed as being limited to applications only within said embodiment.

It will also be appreciated that where a range of values (e.g., less than, greater than, at least, and/or up to a certain value, and/or between two recited values) is disclosed or recited, any specific value or range of values falling within the disclosed range of values is likewise disclosed and contemplated herein.

It is also noted that systems, methods, apparatus, devices, products, processes, compositions, and/or kits, etc., according to certain embodiments of the present invention may include, incorporate, or otherwise comprise properties, features, aspects, steps, components, members, and/or elements described in other embodiments disclosed and/or described herein. Thus, reference to a specific feature, aspect, steps, component, member, element, etc. in relation to one embodiment should not be construed as being limited to applications only within the embodiment. In addition, reference to a specific benefit, advantage, problem, solution, method of use, etc. in relation to one embodiment should not be construed as being limited to applications only within the embodiment.

The headings used herein are for organizational purposes only and are not meant to be used to limit the scope of the description or the claims. To facilitate understanding, like reference numerals have been used, where possible, to designate like elements common to the figures.

Embodiments of the invention, as shown and described by the various figures and accompanying text, provide a headborne attachment platform that protects the skull of a wearer and provides functionality, including the mounting of headborne devices, independent of being attached to a helmet shell.

Figure 2:
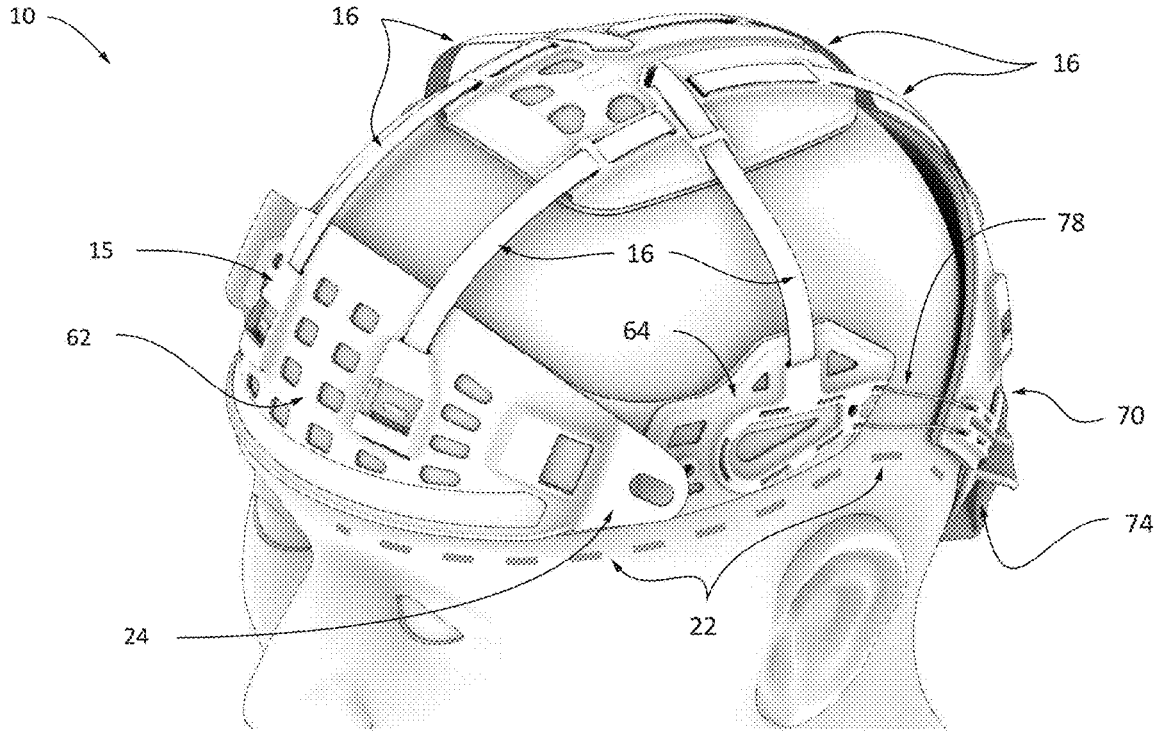
FIG. 2 is a frontal perspective view illustrating the headborne attachment platform of FIG. 1.
Figure 3:
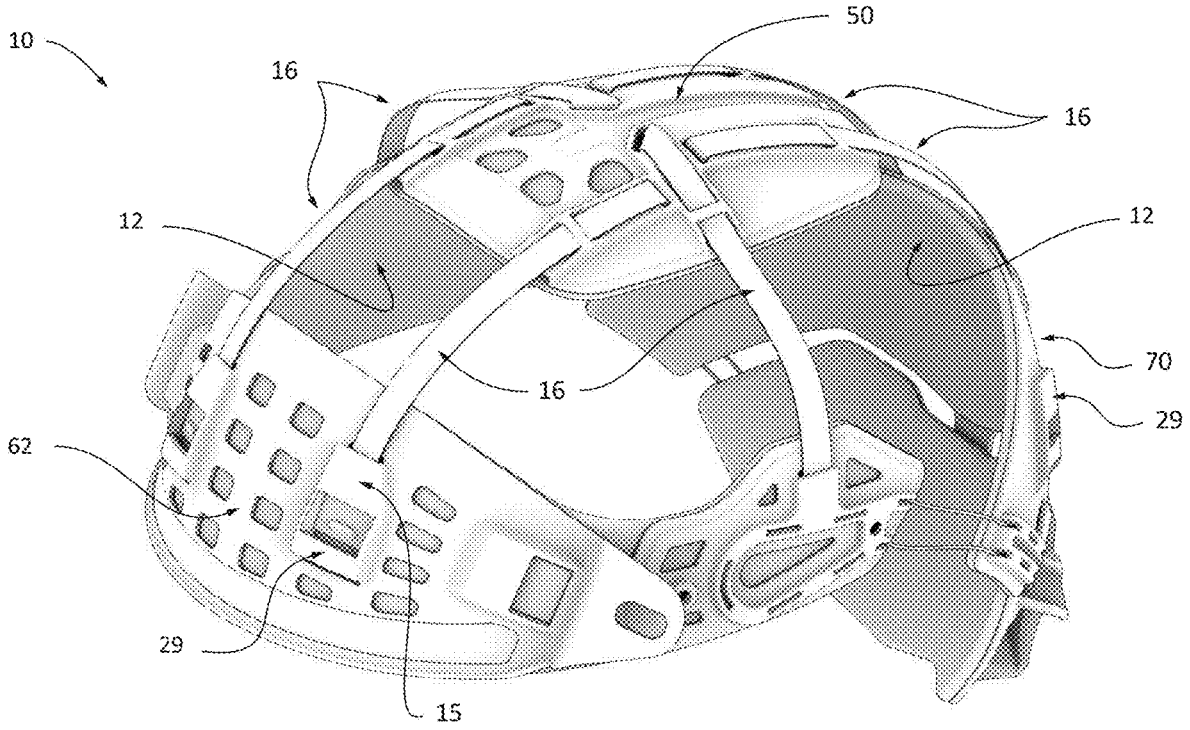
FIG. 3 is a frontal perspective view illustrating the headborne attachment platform of FIG. 1 with interior padding.

FIGS. 1-16 illustrate features of a headborne attachment platform 10 according to an embodiment of the invention. FIG. 1 is a side view illustrating the headborne attachment platform 10 positioned on a skull of a wearer according to an embodiment of the invention. FIG. 2 is a frontal perspective view illustrating the headborne attachment platform 10, and FIG. 3 is a frontal perspective view illustrating the headborne attachment platform 10 with interior padding 12.

The headborne attachment platform 10 is shown with major components of rigid plates 14 and the straps 16 of connecting material, connecting the multiple rigid plates 14 in an assembly, and that have a thickness that is less than their width or length. The comfort padding 12 is attached on the inside of the plates 14 adjacent to the head of the wearer. The straps 16 of connecting material may be more flexible than the rigid plates 14 in directions perpendicular to the thickness of the straps 16. The straps 16 of connecting material may not be stretchable (i.e. they are inelastic) in a direction that can change their length.

The assembly of multiple rigid plates 14 is shaped and connected by the straps 16 of connecting material to sit adjacent to, and surround, the portions of the frontal, temporal, parietal, and occipital bone regions of the skull of the wearer, and define an overall headgear shape and contour, and define a headband region 22 around the skull.

A tightening mechanism 20 is associated with the assembly of multiple rigid plates 14. The tightening mechanism 20 may be configured to adjust a circumference of the headband region 22 of the assembly of multiple rigid plates 16.

Figure 4:
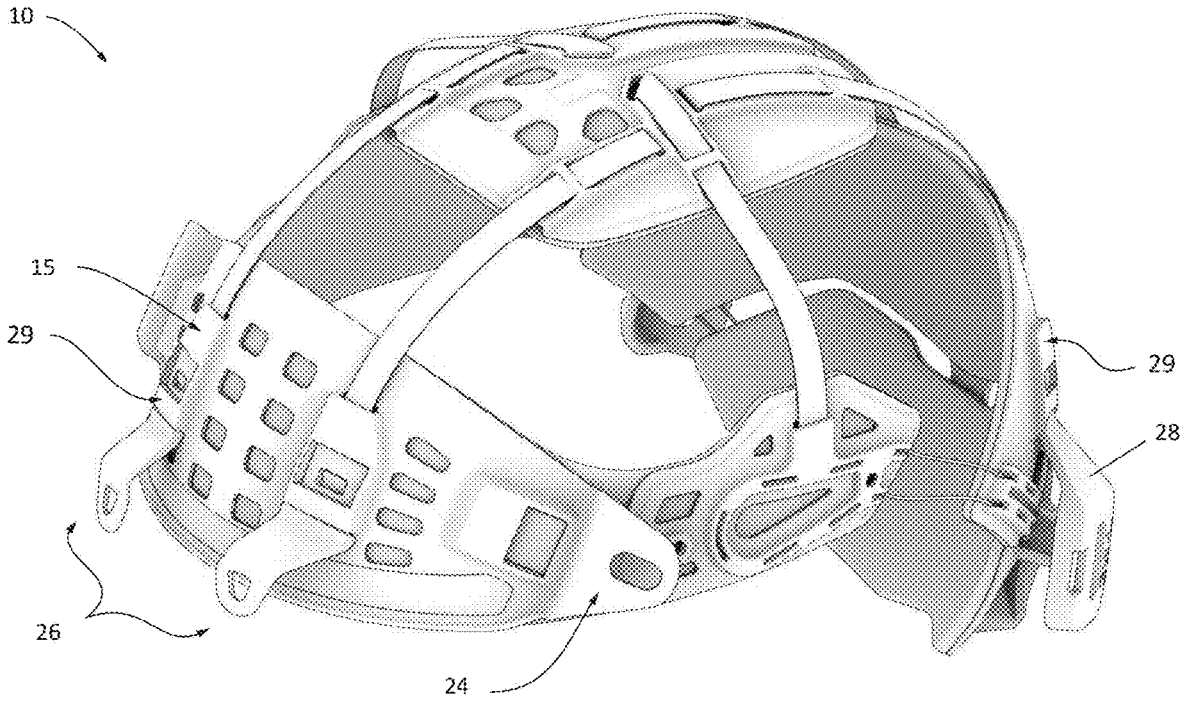
FIG. 4 is a frontal perspective view illustrating the headborne attachment platform of FIG. 1 with helmet mounting features and interior padding.
Figure 5:
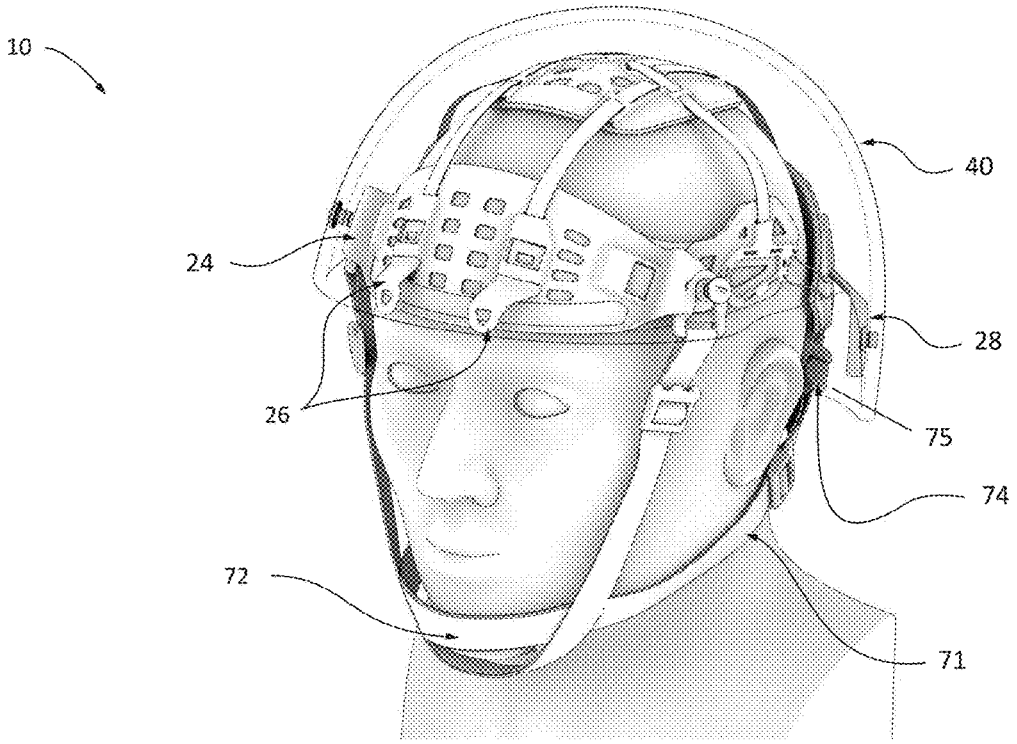
FIG. 5 is a frontal perspective view illustrating the headborne attachment platform of FIG. 1 positioned on a wearer's skull with an outer helmet shell mounted thereon.
Figure 6:
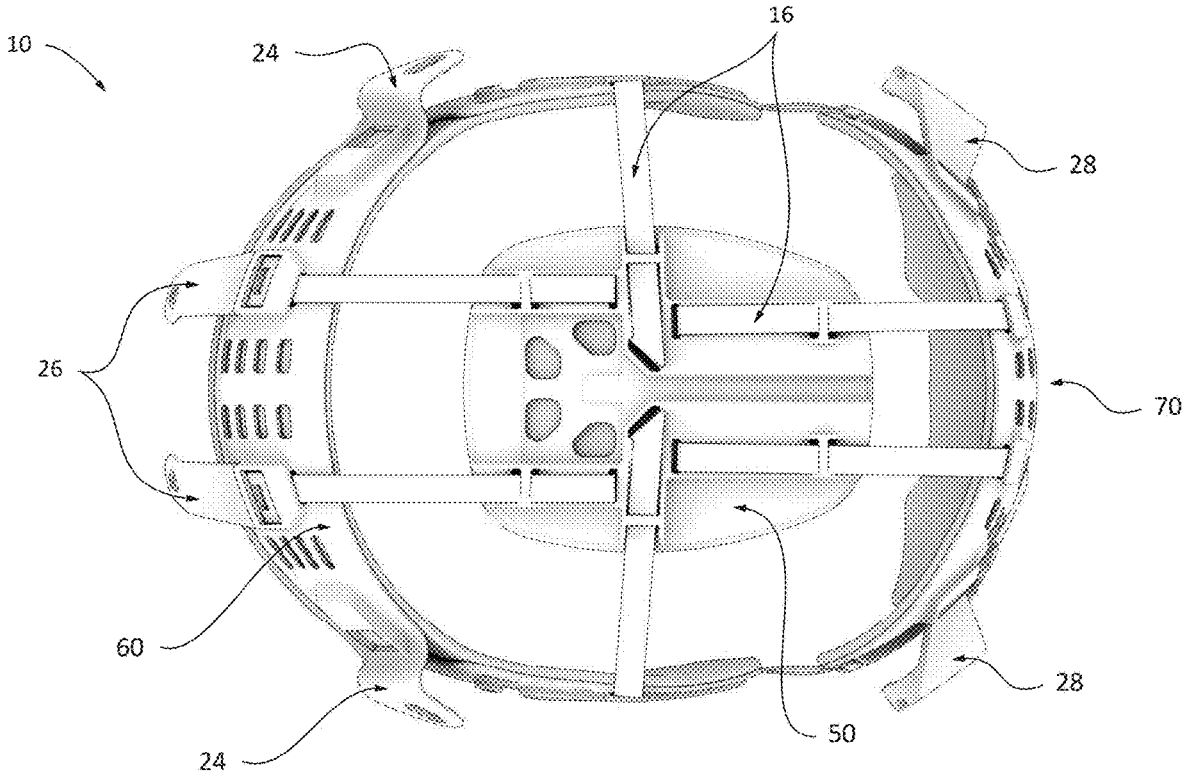
FIG. 6 is a top view illustrating the headborne attachment platform of FIG. 1 with outer helmet shell mounting features.

Referring additionally to FIGS. 4-6, the rigid plates 14 may have mounting features 24, 26, 28 configured to mount an outer helmet shell 40, FIG. 4 is a frontal perspective view illustrating the headborne attachment platform 10 with helmet mounting features 24, 26, 28 and interior padding 12. FIG. 5 is a frontal perspective view illustrating the headborne attachment platform 10 positioned on a wearer's skull with the outer helmet shell 40 mounted thereon. FIG. 6 is a top view illustrating the headborne attachment platform 10 with outer helmet shell mounting features 24, 26, 28.

The mounting features may include front 26 and rear 28 mounting features as attachable mounting members that include support surfaces 29 for connection to, and suspension of, an outer helmet shell 40 around the headborne attachment platform 10. Temporal mounting features 24 may be integrated with the frontal rigid plate 60. As such, it may be appreciated that each of mounting features 24, 26, 28 may be attachable or integrated mounting features for mounting either an outer helmet shell 40 or other headborne devices such as lights, night vision, cameras, etc.

The mounting features 24, 26, 28 may define bridge features that enable the outer helmet shell 40 to be attached to it. These bridge features are designed and located to create a stand-off distance between the rigid plates 14 to keep the inner surface of the outer helmet shell 40 a distance apart from the head. This is commonly referred to as the head to shell stand-off distance. The rigid behavior of the plates 14, and the rigid plates 14 working in conjunction with the straps 16 of inter-connecting material as an assembly is what allows the headgear assembly to maintain its structure when subjected to forces exerted upon them by an outer helmet shell 40 or other devices attached to it. The assembly working in both tension and compression is what maintains the stand-off distance in all locations inside the outer helmet shell 40. FIG. 5 shows the bridge features that enable an outer helmet shell 40 to be attached to it the headborne attachment platform 10. It is noted that the mounting features 24, 26, 28 may be removed from the rigid plates 14 in instances where there isn't a need to support the attachment of the outer helmet shell 40.

This is an upgrade over prior art approaches that only maintain the head to interior helmet shell standoff distance in some locations. By maintaining a uniform stand-off distance in all locations, helmet safety is improved since it can now provide protection in all locations, as opposed to some.

The rigid plates 14 are independently and sufficiently rigid to support and maintain their three-dimensional shape when subjected to forces exerted upon them by the outer helmet shell 40 or headborne device 42. The rigid plates 14 include attachment features 15 configured to provide for the attachment and detachment of the straps 16 of connecting material so that the rigid plates 14 are coupled together in the assembly and can be independently adjusted and set to selectable distances apart from each other using the straps 16 of connecting material. For example, the attachment features may include fasteners (e.g. screws or rivets), welds, and/or hook and loop fastening material that is attached to the rigid plates 14 as well as the straps 16 of connecting material and used for their adjustment, attachment, and detachment to the rigid plates 14. Alternatively, the straps 16 of connecting material may be passed through diving board slots, e.g. in the top rigid plate 50, which have an interference "pinch" fit which attaches and keeps the straps 16 from moving relative to the top rigid plate 50 unless the diving board slot is manually depressed.

As described, the assembly of multiple rigid plates 14 is shaped and connected by the straps 16 of connecting material such that the assembly can provide all of its functionality independent of being attached to an outer helmet shell.

One of the multiple rigid plates 14 is a frontal rigid plate 60 with a central portion 62 to sit adjacent to the frontal bone region of the skull and opposing side portions 64 to sit adjacent the temporal bone regions of the skull. The central portion 62 is relatively less flexible in directions toward and away from the skull than the side portions 64. As such, the central portion 62 of the frontal rigid plate 60 may have a hemispherical shape that is less flexible in the direction that would increase or decrease a radius of its shape relative to rotation about an axis between basic and coronal planes of the skull (see the reference planes illustrated in FIG. 29) than it is flexible in the direction that would increase or decrease the radius of its shape relative to rotation about an axis between the basic and midsagittal planes of the skull. The side portions 64 of the frontal rigid plate 60 have flexibility inward and outward in a direction towards each other, the skull, and the midsagittal plane of a headform.

One of the multiple rigid plates is a rear rigid plate 70 to sit adjacent the parietal and occipital bone regions of the skull. The tightening mechanism 20 includes an actuation mechanism 21 carried by the rear rigid plate 70 and configured to selectively cause the frontal rigid plate 60 to move closer to the rear rigid plate 70 in an area surrounding the headband region 22 of the assembly, thereby adjusting the circumference, tension, and pressure exerted upon the skull by the headband region 22 of the assembly for fitting purposes.

Figure 7:
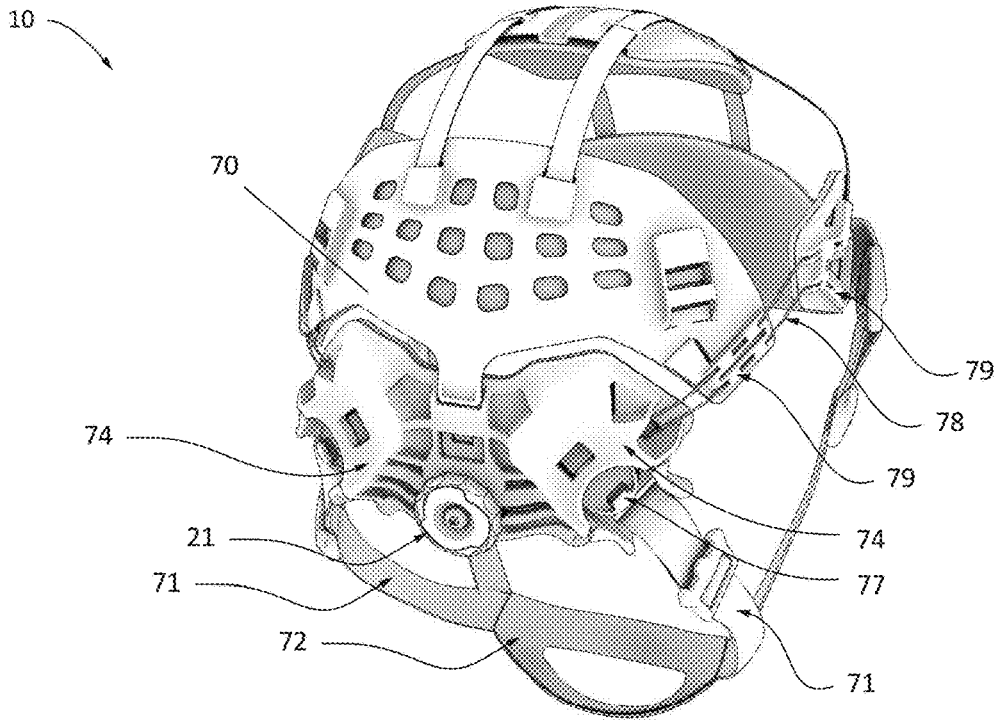
FIG. 7 is a rear perspective view illustrating the headborne attachment platform of FIG. 1 with chinstrap attachment features and tightening mechanism.

With additional reference to FIGS. 5 and 7, a chinstrap 72 and associated features will be described. The rear rigid plate 70 may include features to provide for attachment of the chinstrap 72 that extends around at least one of a neck area and chin area of the wearer. The chinstrap attachment features are preferably tool-less releasable buckle receivers 74 adjacent the actuation mechanism 21. As shown, the tool-less releasable buckle receivers 74 are positioned on opposite sides of the actuation mechanism 21 on the rear rigid plate 70. The headborne attachment platform 10 is shown with the chinstrap 72 attached at four points in the locations at the front 73 and in the back 75 which have a mirrored attachment in the same locations on the opposite side of the head. In this embodiment, a snap fit buckle 77 is attached to the rear two of the four chinstrap straps 71 and allows the chinstrap 72 to be attached and detached from the rear rigid plate 70.

The actuation mechanism 21 may be a dial mechanism 76 with associated lace 78 arranged through lace coupling features 79 on the rear rigid plate 70 that extend to the frontal rigid plate 60 and surround the portions of the headband region 22 of the skull of the wearer. The dial mechanism 76 is configured to selectively shorten and lengthen the lace 78 such that actuating the dial mechanism 76 adjusts portions of the rigid plates 14 around the headband region 22 to move closer to, and farther away from the skull thereby adjusting the circumference of the assembly of multiple rigid plates 14 as well as an interior volume of space where the skull sits adjacent to the assembly of multiple rigid plates 14.

Figure 8:
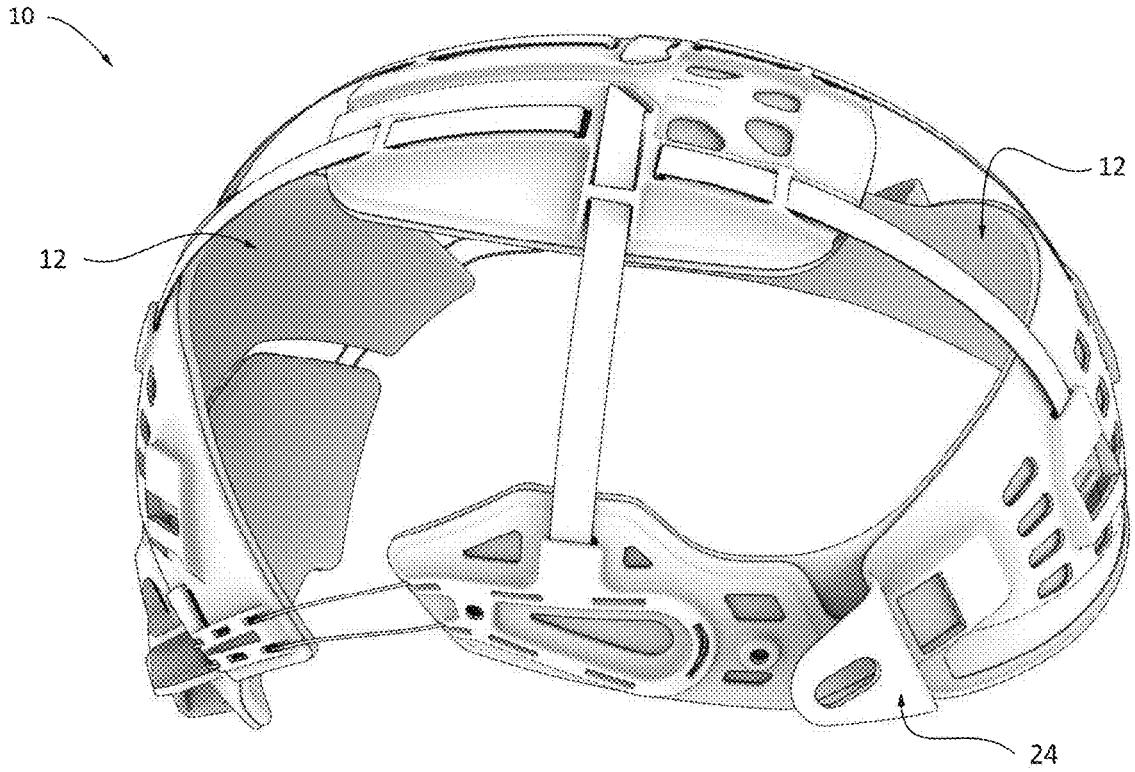
FIG. 8 is another perspective view illustrating the headborne attachment platform of FIG. 1 with interior padding and outer helmet shell mounting features.
Figure 9:
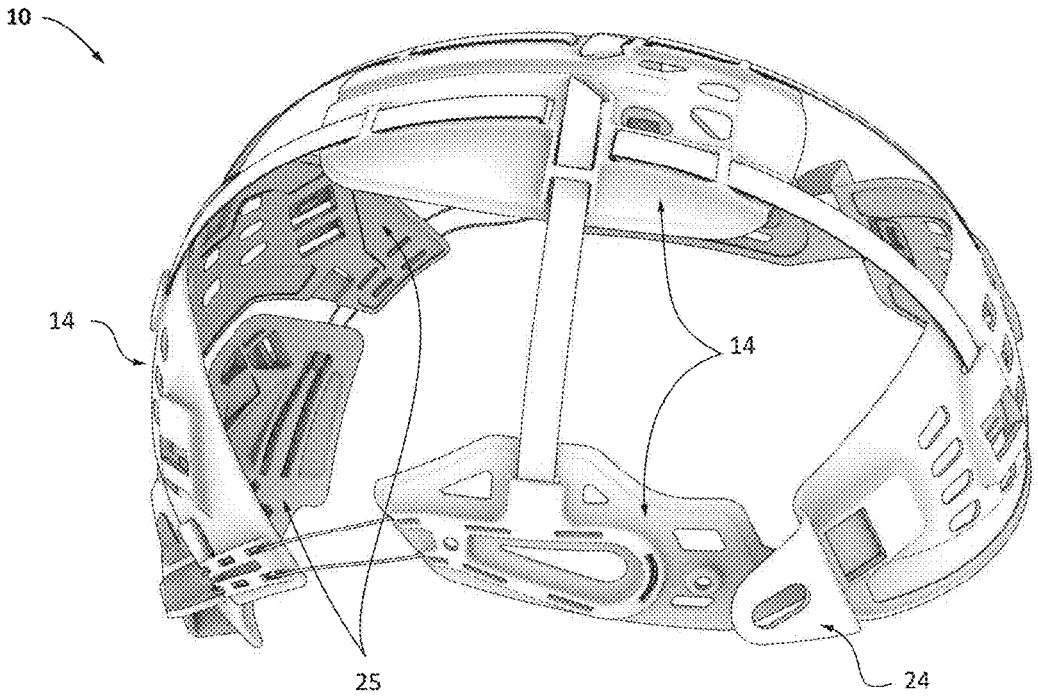
FIG. 9 is another perspective view illustrating the headborne attachment platform of FIG. 8 with outer helmet shell mounting features and without interior padding.

In alternative embodiments, the actuation mechanism 21 may be a worm gear mechanism, a rack and pinion mechanism, and a spool and lace winding mechanism, as would be appreciated by those skilled in the art, FIG. 8 is another perspective view illustrating the headborne attachment platform 10 with interior padding 12 and outer helmet shell mounting features 24. FIG. 9 is another perspective view illustrating the headborne attachment platform 10 with outer helmet shell mounting features 24 and with the interior padding 12 having been removed. The rigid plates 14 may include padding attachment features 25 to provide for attachment of comfort padding materials 12 on a side that is adjacent to the skull of the wearer. The padding attachment features 25 may be hook and loop fasteners, for example.

Figure 10:
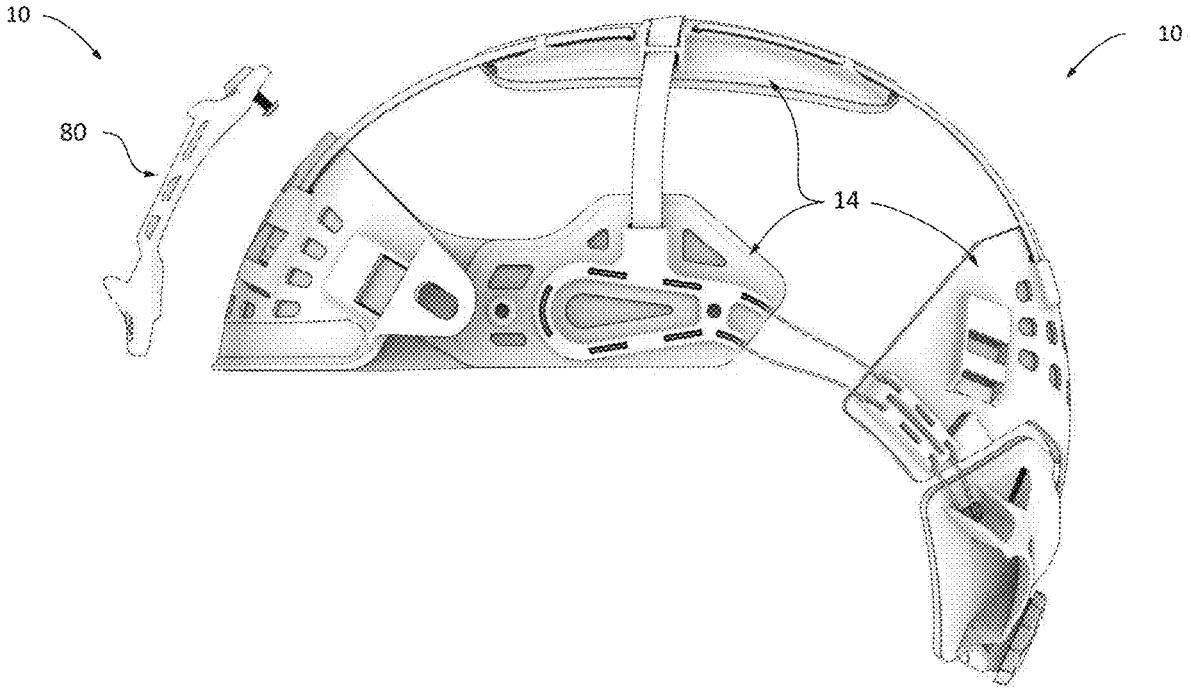
FIG. 10 is side view illustrating the headborne attachment platform of FIG. 1 with a headborne device mounting feature.
Figure 11:
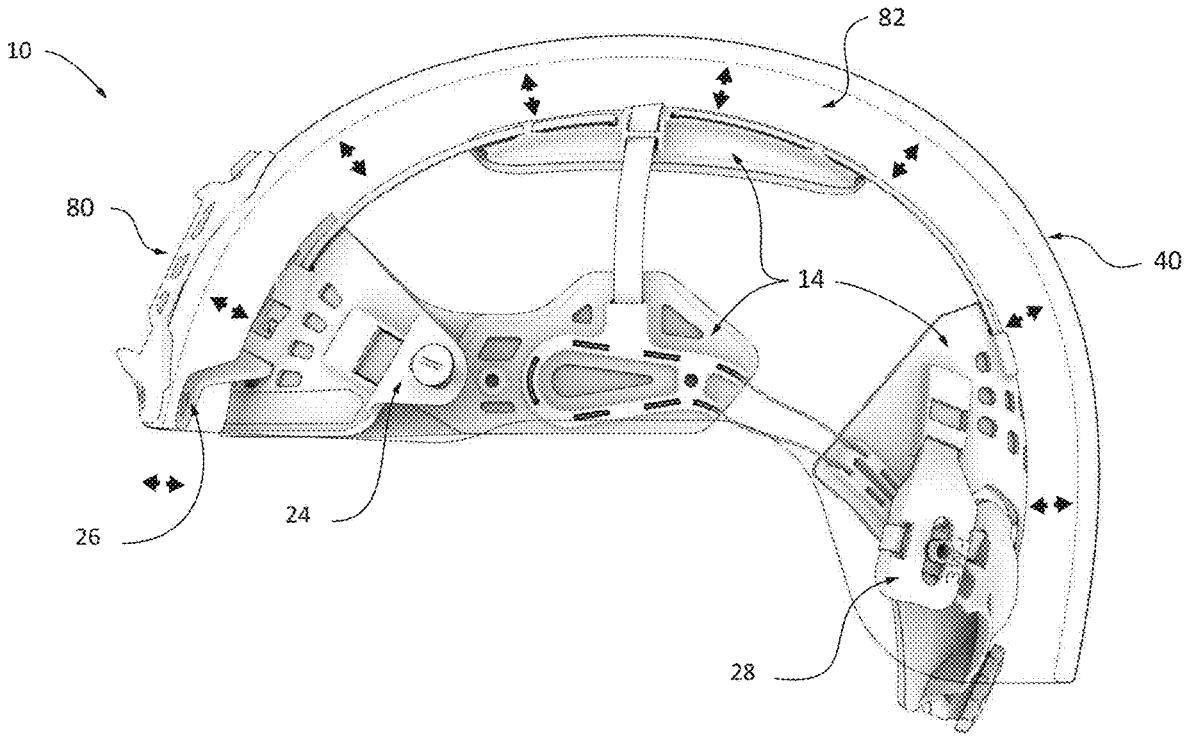
FIG. 11 is another side view illustrating the headborne attachment platform of FIG. 1 with an outer helmet shell and headborne device mounted thereon.
Figure 12:
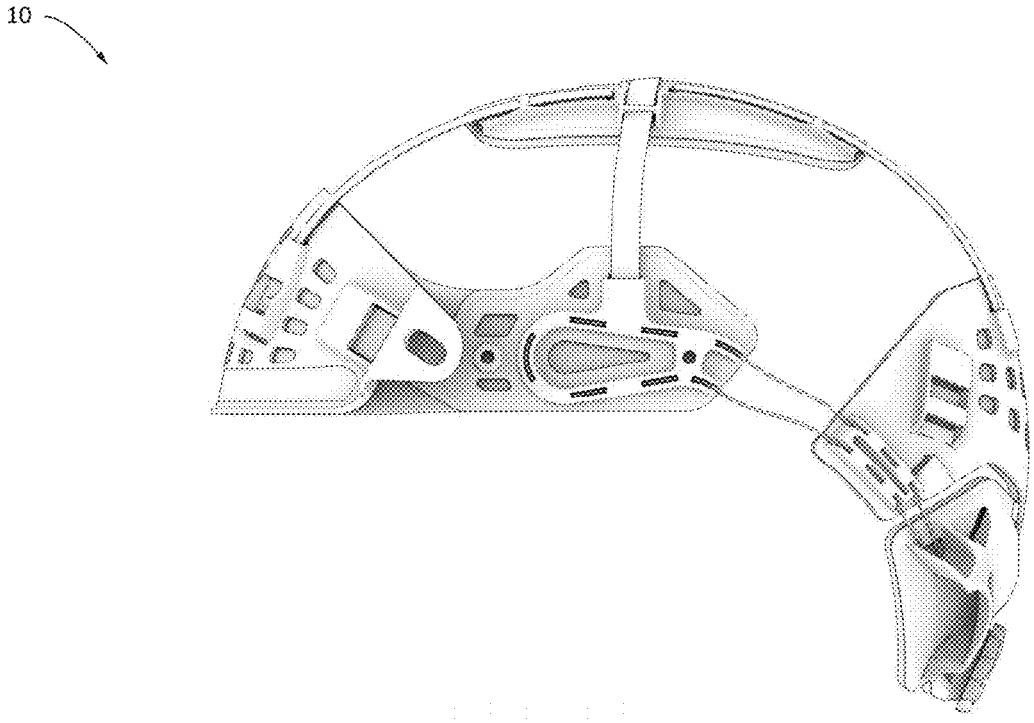
FIG. 12 is another side view illustrating the headborne attachment platform of FIG. 11 without the outer helmet shell.

FIG. 10 is side view illustrating the headborne attachment platform 10 with a headborne device mounting feature 80. FIG. 11 is another side view illustrating the headborne attachment platform 10 with an outer helmet shell 40 and headborne device mounting feature 80 thereon. FIG. 12 is another side view illustrating the headborne attachment platform 10 without the outer helmet shell 40.

FIG. 10 shows an example of a location on the rigid plates 14, with the headborne device mounting feature 80 thereon, that can be used for attaching other headborne devices or equipment such as night vision goggles, illumination and identification devices. FIG. 11 shows the outer helmet shell 40 attached to the headborne attachment platform in the locations of the mounting features 24, 26, 28 or bridge features. It also shows the head to shell stand-off distance space 82 between the rigid plates 14 and the helmet interior that provides improved protection.

Figure 13:
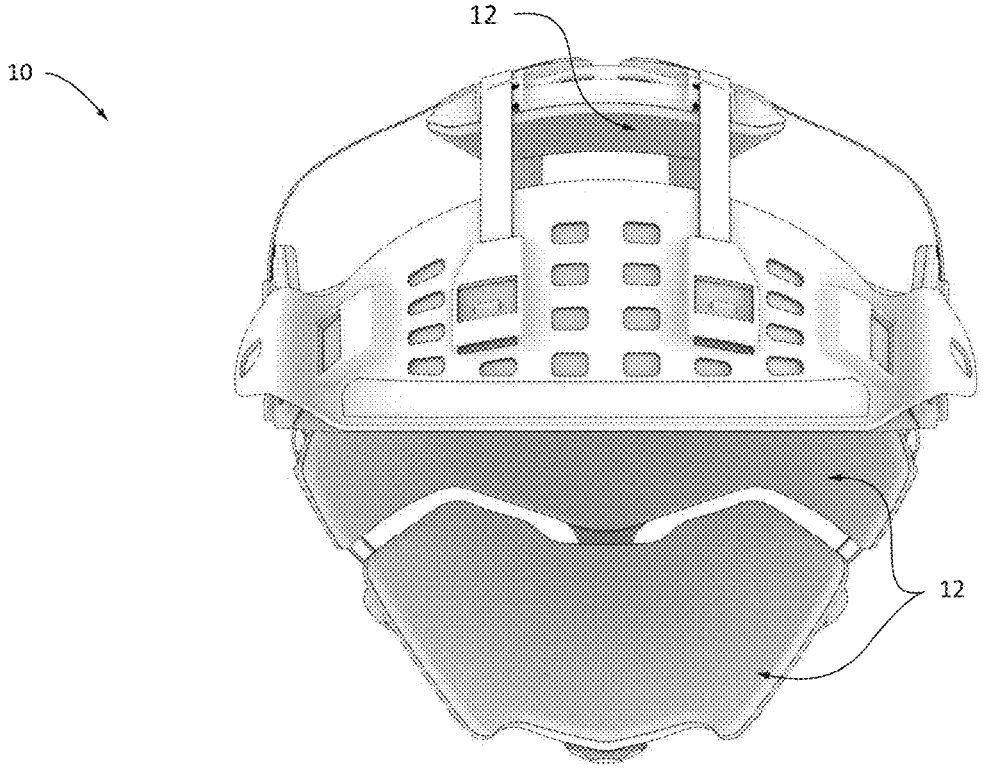
FIG. 13 is a front view illustrating the headborne attachment platform of FIG. 1 with interior padding.
Figure 14:
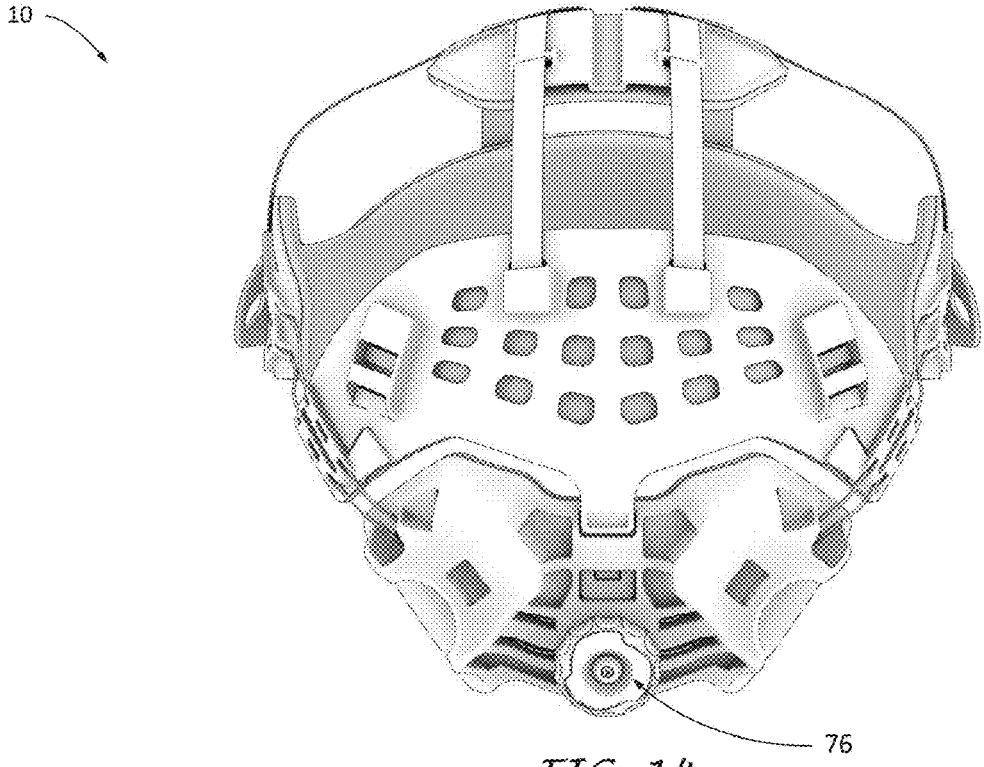
FIG. 14 is a rear view illustrating the headborne attachment platform of FIG. 1 with tightening mechanism.
Figure 15:
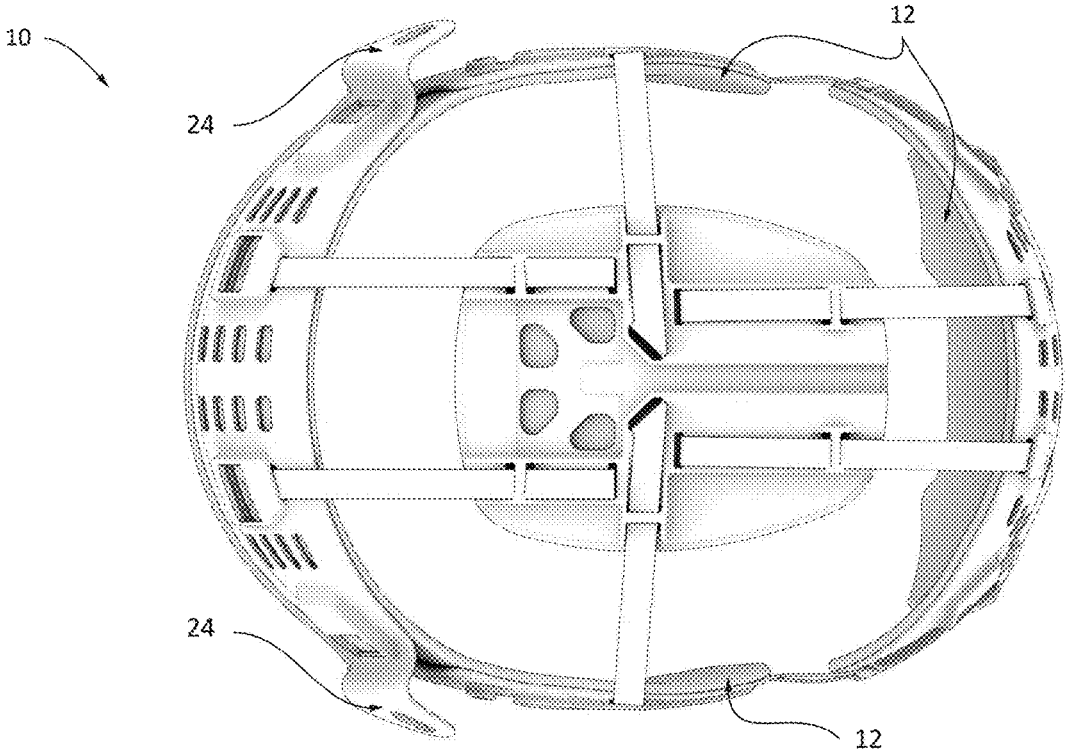
FIG. 15 is another top view illustrating the headborne attachment platform of FIG. 1 with interior padding and without outer helmet shell mounting features.
Figure 16:
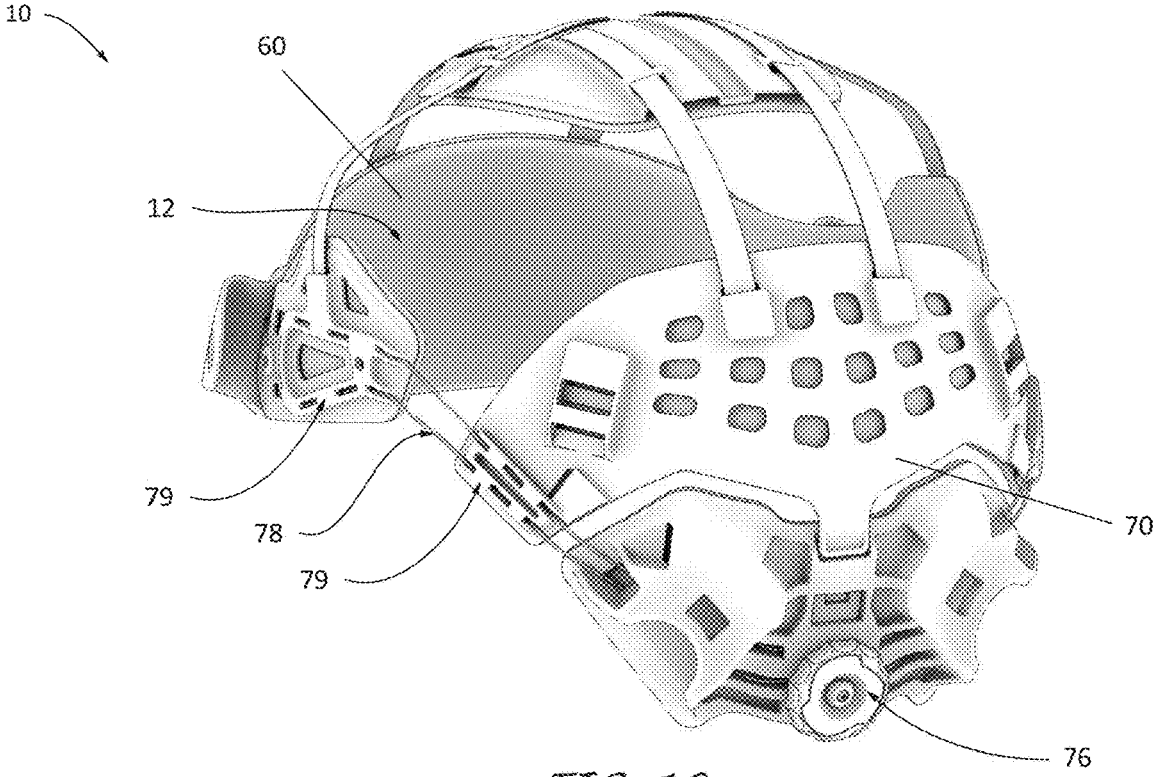
FIG. 16 is rear perspective view illustrating the headborne attachment platform of FIG. 1 with interior padding and tightening mechanism.

FIG. 13 is a front view illustrating the headborne attachment platform 10 with interior padding 12. FIG. 14 is a rear view illustrating the headborne attachment platform 10 with dial mechanism 76, FIG. 15 is another top view illustrating the headborne attachment platform 10 with the interior padding 12 and without outer helmet shell mounting features 24, 26, 28. FIG. 16 is rear perspective view illustrating the headborne attachment platform 10 with interior padding 12 and dial mechanism 76 with associated lace 78 arranged through lace coupling features 79 on the rear rigid plate 70 that extend to the frontal rigid plate 60 and surround the portions of the headband region 22 of the skull of the wearer.

Figure 17:
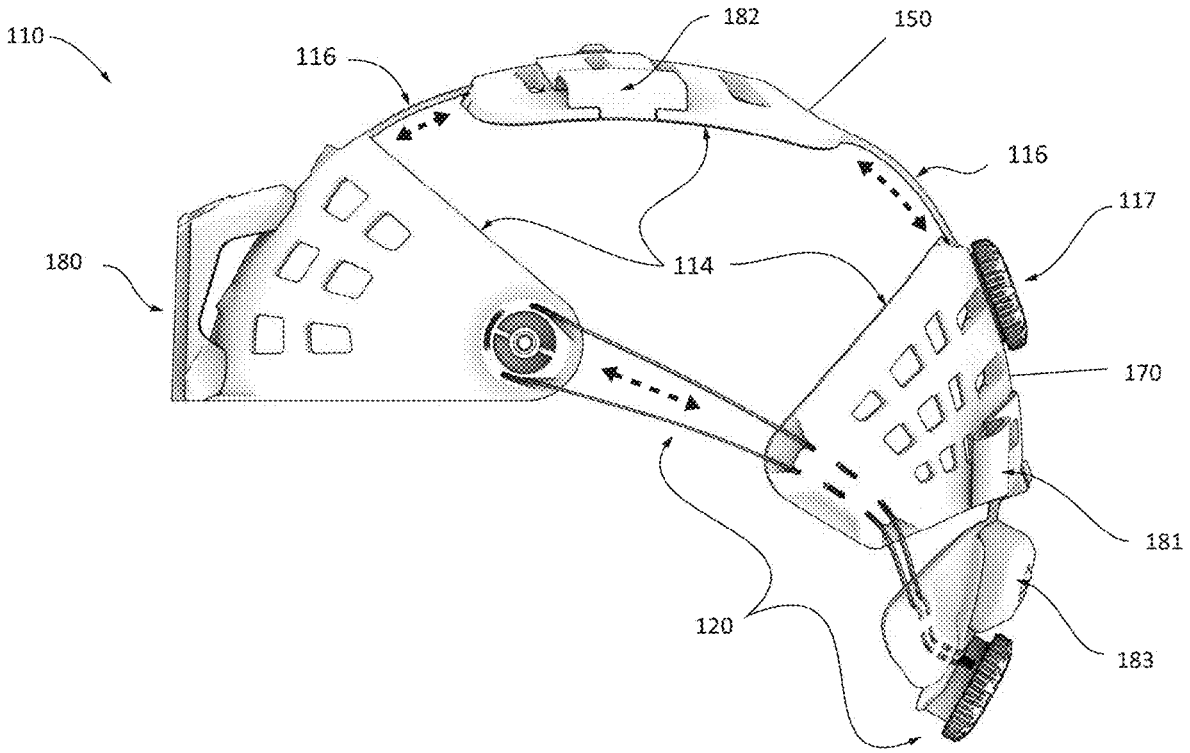
FIG. 17 is a side view illustrating a headborne attachment platform according to another embodiment including headborne device mounting features.

With reference to FIGS. 17-26, another embodiment of the headborne attachment platform 110 with rigid plates 114 and integrated straps 116 will be described. It may be described that the straps 116 of connecting material are defined by a reduced width portion of one of the rigid plates 114. Again, the straps 116 of connection material are inelastic and only flexible in the directions toward and away from the skull, FIG. 17 is a side view illustrating the headborne attachment platform 110 including headborne device mounting feature 180 thereon. The headborne device mounting feature 180 is illustratively shown on a frontal rigid plate 160. Other headborne device mounting features 181 may be mounted on the rear rigid plate 170. Also, other headborne device mounting features 182 may be mounted on the top rigid plate 150.

Figure 18:
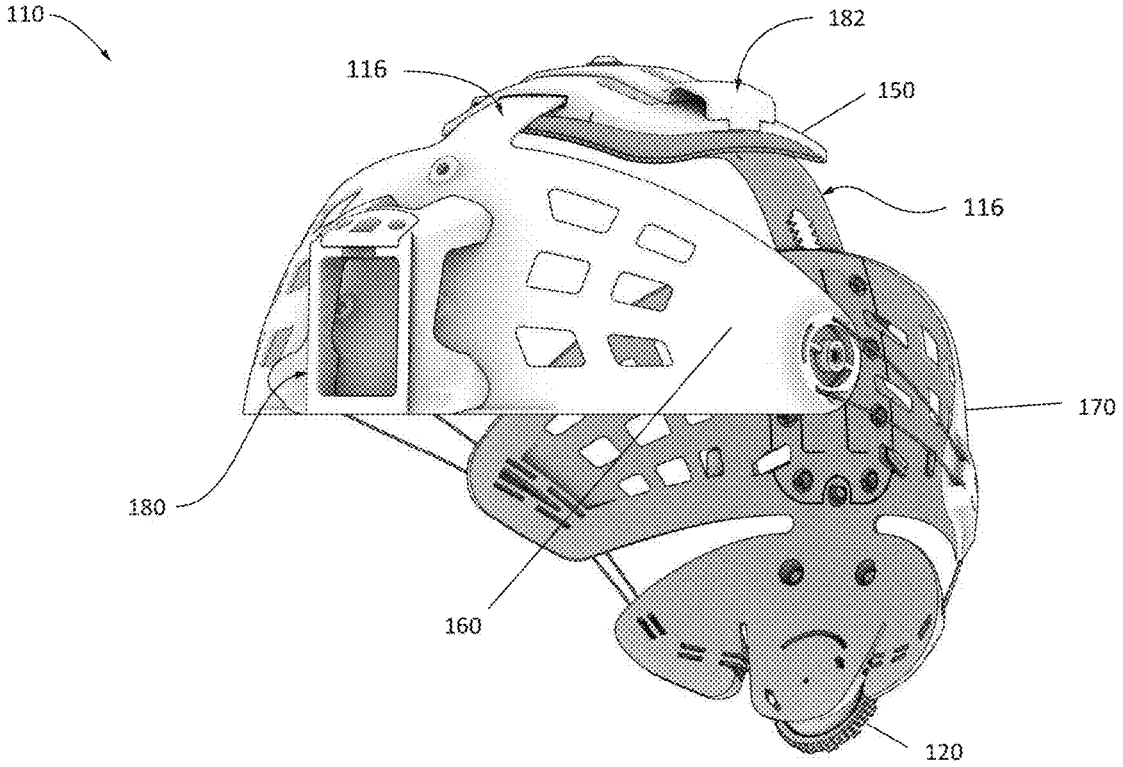
FIG. 18 is a front perspective view illustrating the headborne attachment platform of FIG. 17 with the headborne device mounting features.
Figure 19:
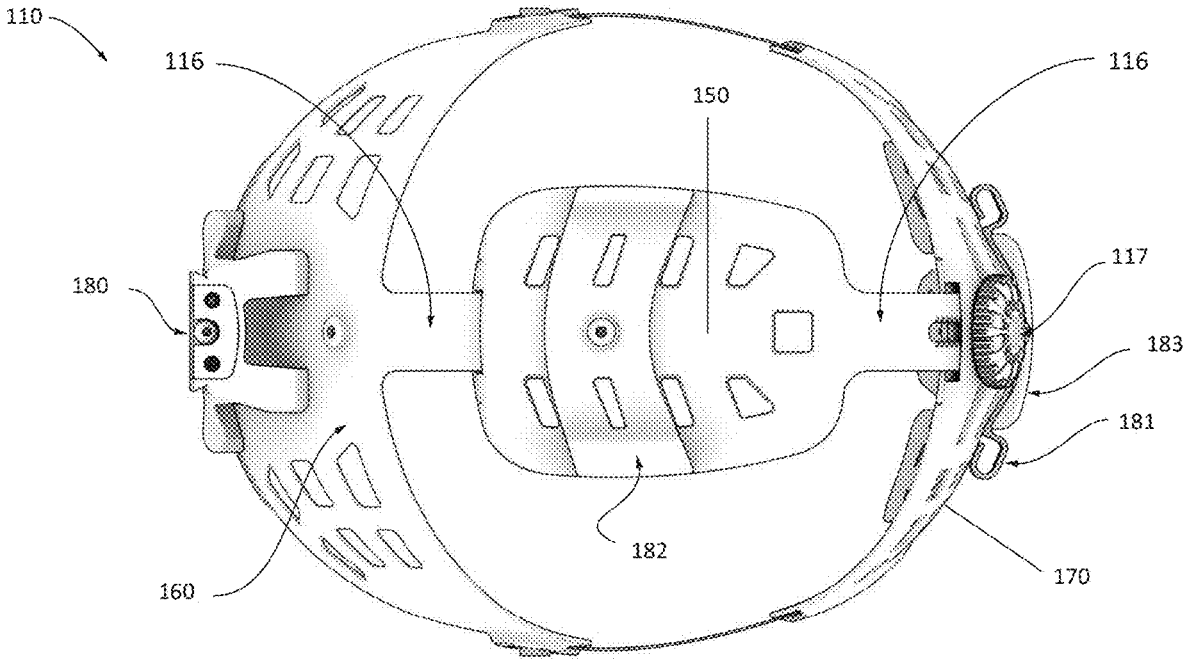
FIG. 19 is top view illustrating the headborne attachment platform of FIG. 17 with headborne device mounting features and tightening mechanism.
Figure 20:
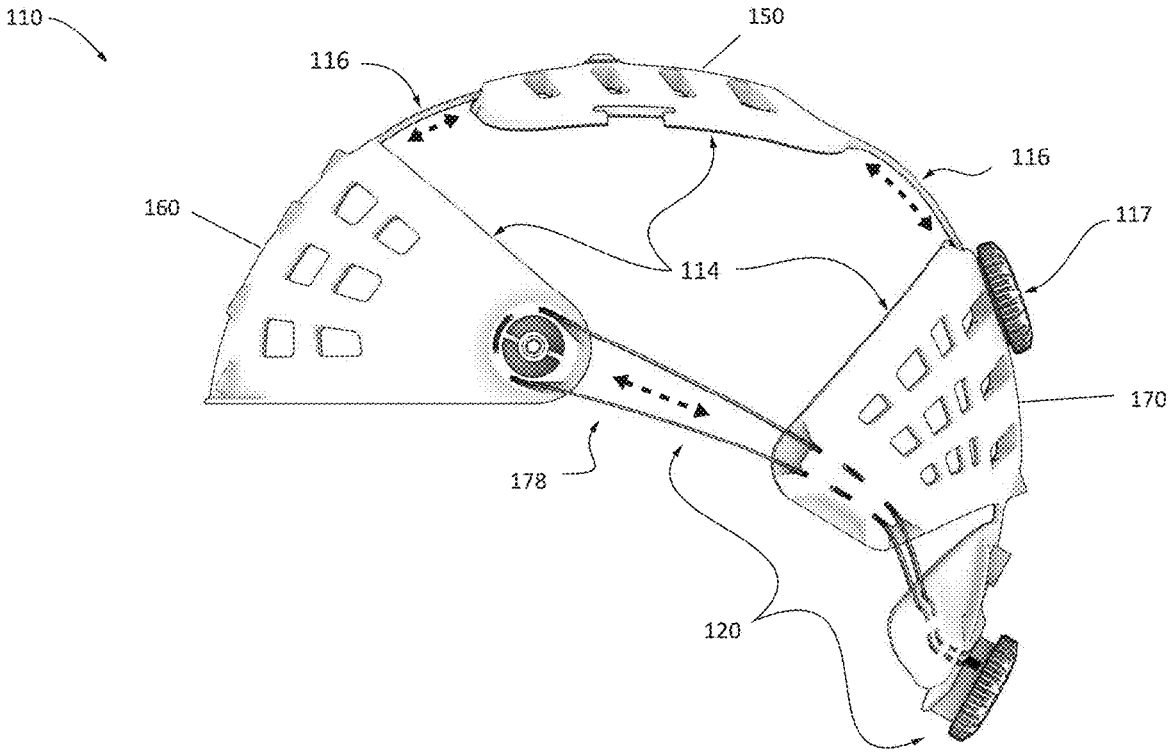
FIG. 20 is side view illustrating the headborne attachment platform of FIG. 17 with the tightening mechanism.
Figure 21:
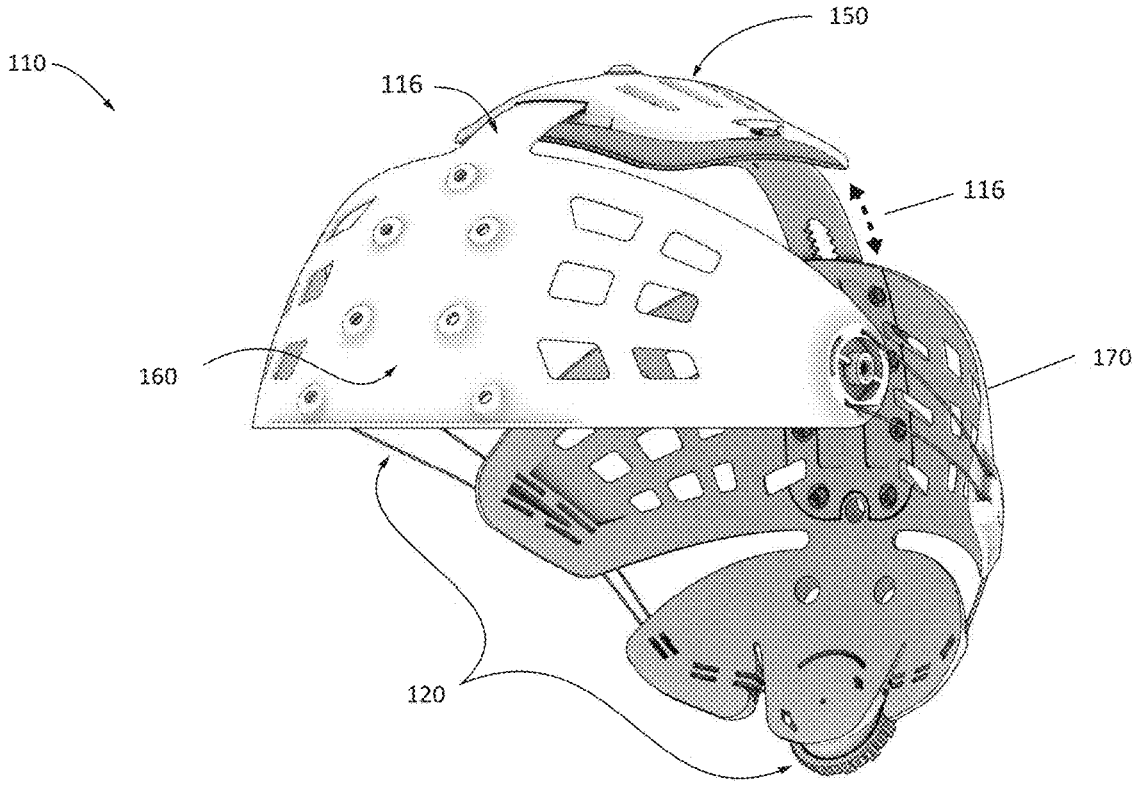
FIG. 21 is frontal perspective view illustrating the headborne attachment platform of FIG. 17 without the headborne device mounting features and with a tightening mechanism.
Figure 22:
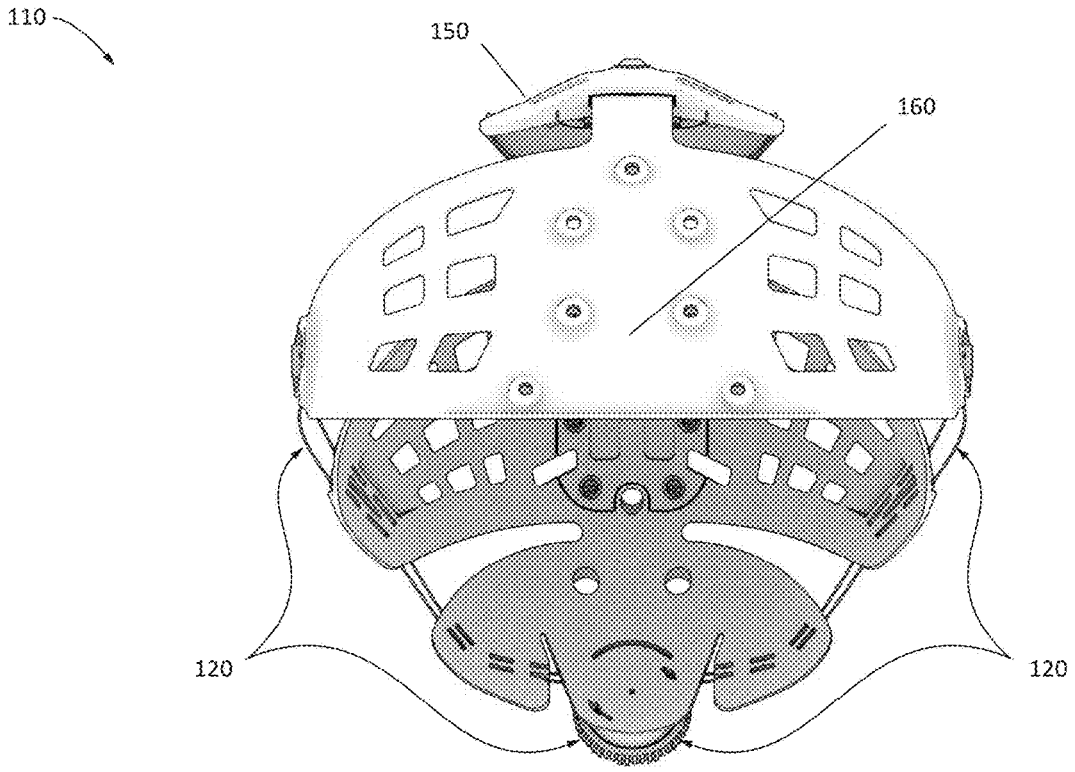
FIG. 22 is front view illustrating the headborne attachment platform of FIG. 17 without the headborne device mounting features and with the tightening mechanism.
Figure 23:
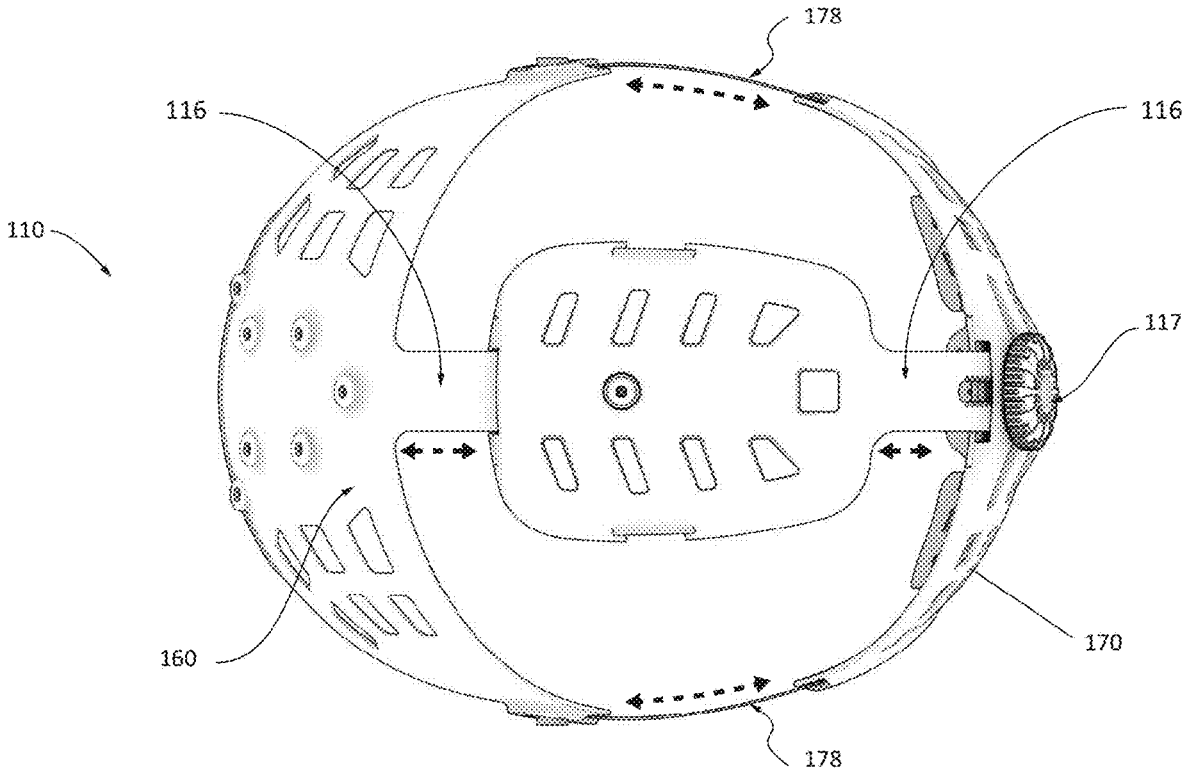
FIG. 23 is top view illustrating the headborne attachment platform of FIG. 17 without the headborne device mounting feature and with the tightening mechanism.
Figure 24:
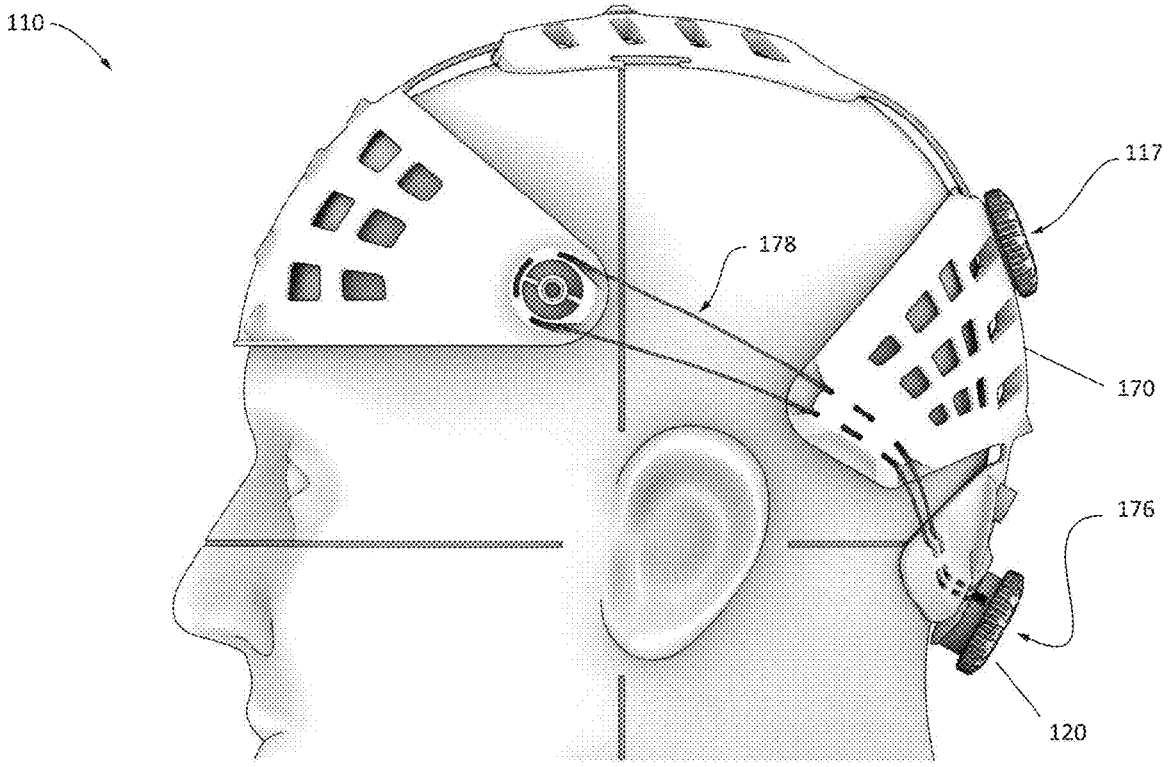
FIG. 24 is side view illustrating the headborne attachment platform of FIG. 17 with the tightening mechanism and positioned on a wearer's skull with reference coronal and basic planes.
Figure 25:
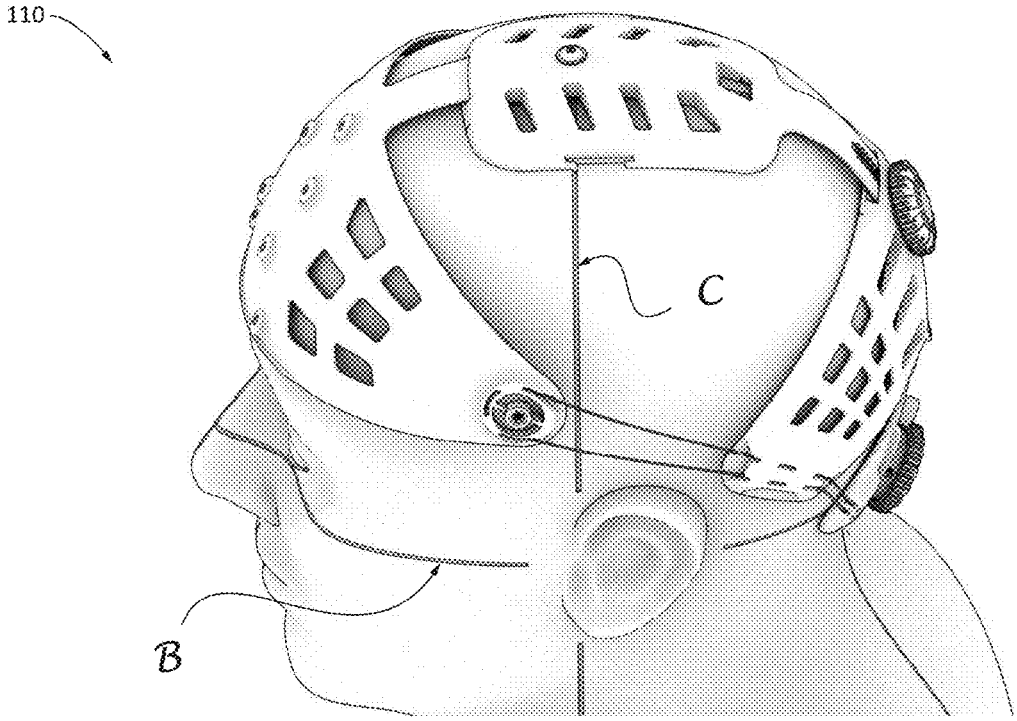
FIG. 25 is perspective view illustrating the headborne attachment platform of FIG. 24 with the tightening mechanism and positioned on a wearer's skull with reference coronal and basic planes.

FIG. 18 is a front perspective view illustrating the headborne attachment platform 110 with the headborne device mounting feature 180 mounted on the frontal rigid plate 160, FIG. 19 is top view illustrating the headborne attachment platform 110 with the headborne device mounting feature 160 on the frontal rigid plate 160, and the tightening mechanism 120 on the rear rigid plate 170. FIG. 20 is side view illustrating the headborne attachment platform 110 with the tightening mechanism 120. FIG. 21 is frontal perspective view, and FIG. 22 is front view, and FIG. 23 is top view, illustrating the headborne attachment platform 110 without the headborne device mounting feature 160 and with the tightening mechanism 120. Again, the tightening mechanism 120 may be a dial mechanism 176 with associated lace 178 arranged through lace coupling features 179 on the rear rigid plate 170 that extend to the frontal rigid plate 160 and surround the portions of the headband region 122 of the skull of the wearer, FIG. 24 is side view, and FIG. 25 is perspective view, illustrating the headborne attachment platform 110 with the tightening mechanism 120, and the headborne attachment platform 110 is positioned on a wearer's skull with reference coronal C and basic B planes.

Figure 26:
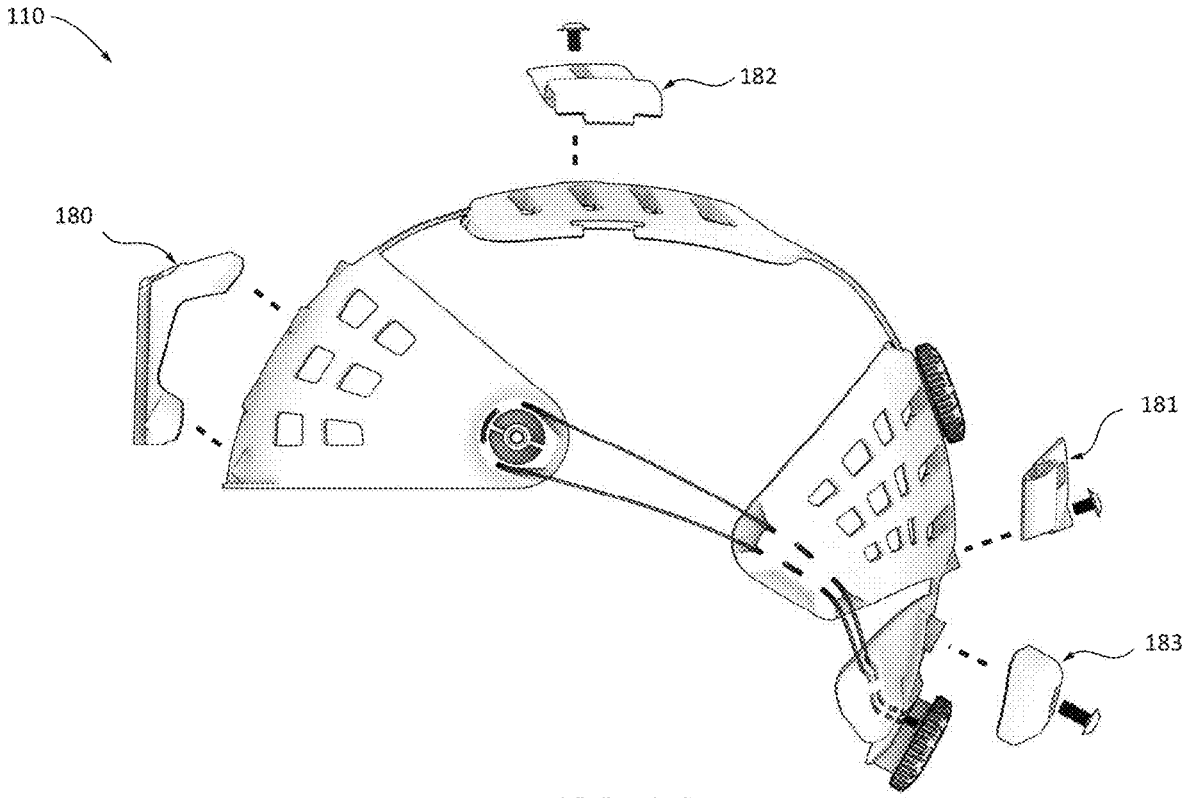
FIG. 26 is an exploded side view illustrating the headborne attachment platform of FIG. 17 with the tightening mechanism and headborne device mounting features.
Figure 27:
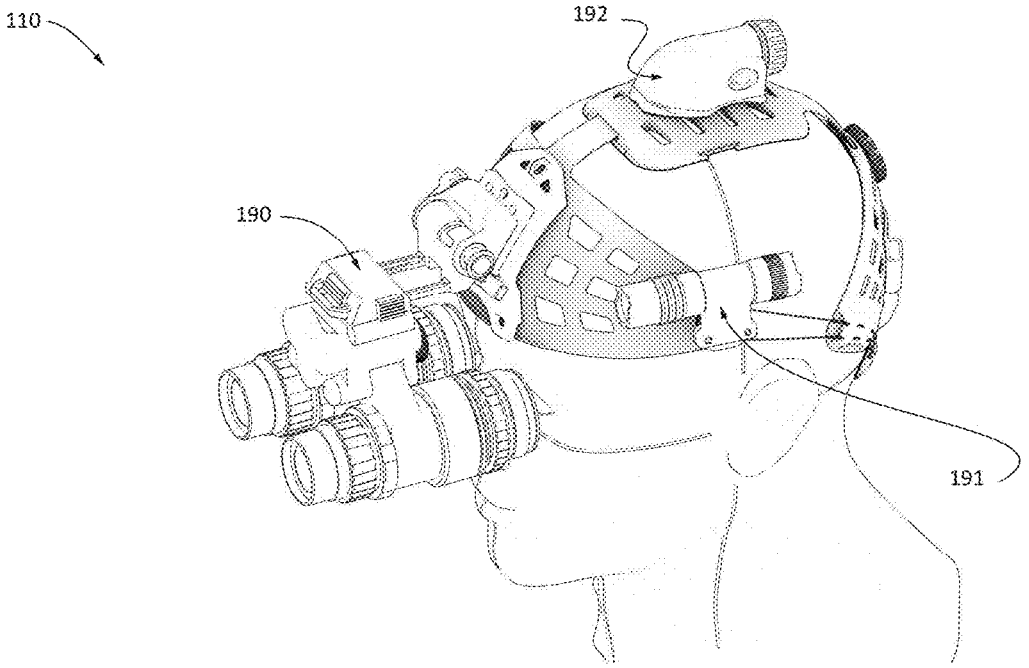
FIG. 27 is a perspective view illustrating the headborne attachment platform of FIG. 17 with the headborne device mounting features and various headborne devices mounted thereon.
Figure 28:
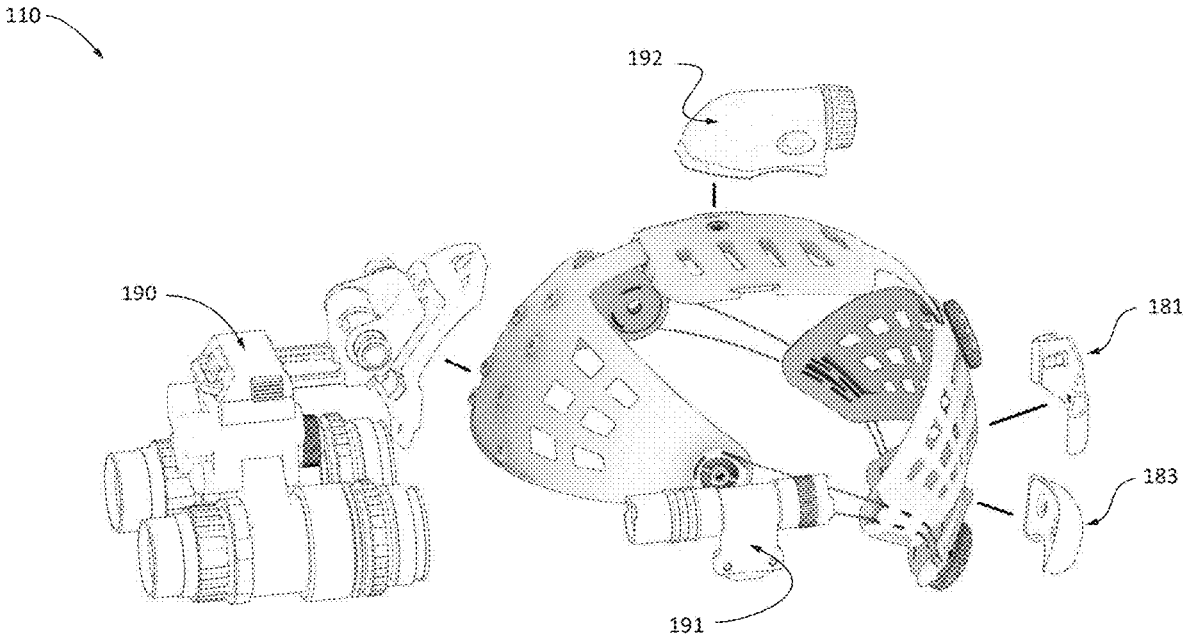
FIG. 28 is an exploded view illustrating the headborne attachment platform of FIG. 17 with the headborne device mounting features and various headborne devices associated therewith.
Figure 29:
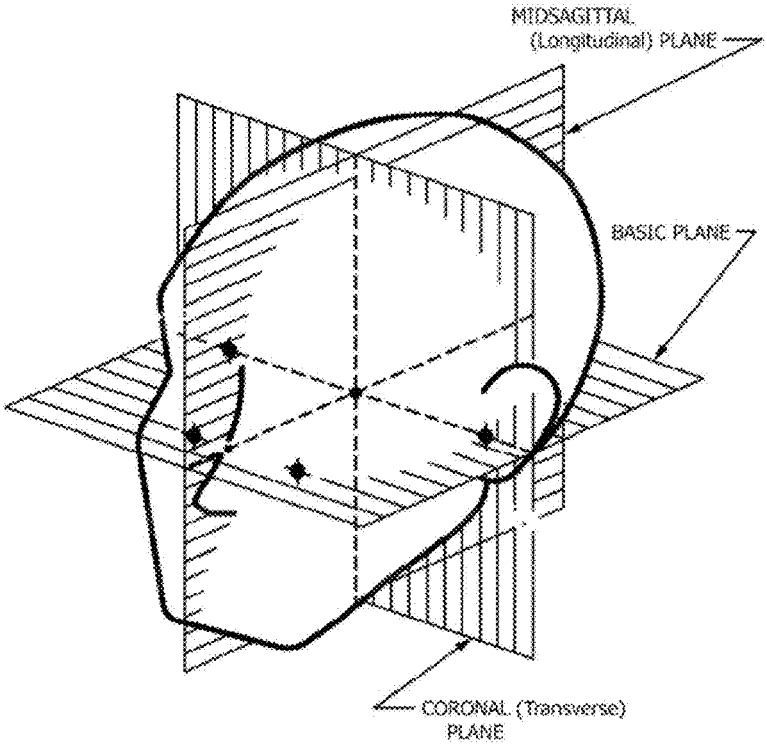
FIG. 29 is a perspective view of a headform with basic, coronal and midsagittal planes.
Figure 30:
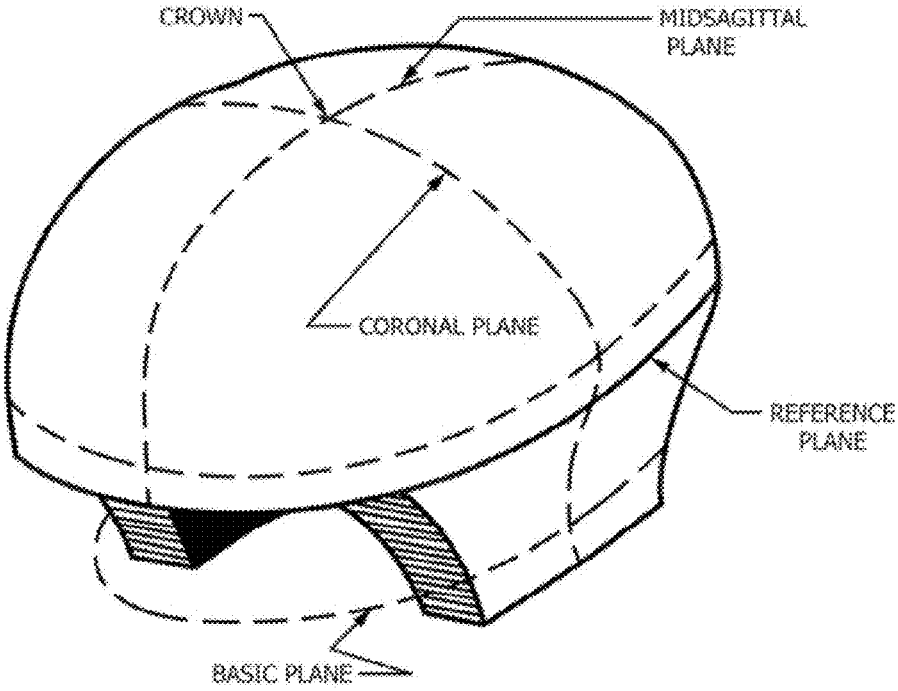
FIG. 30 is a perspective view of a test headform with basic, coronal and midsagittal planes.

FIG. 26 is an exploded side view illustrating the headborne attachment platform 110 with the tightening mechanism and various headborne device mounting features 180, 181 and 182 being shown as removable (e.g., via a screw) headborne device mounting features to be positioned on the rigid plates 114. FIG. 27 is a perspective view, and FIG. 28 is an exploded view, illustrating the headborne attachment platform 110 with the headborne device mounting features 180, 181, 182 and various headborne devices associated therewith. The various headborne devices may include night vision goggles 190, illumination 191 and an identification device 192, for example. Other headborne devices are also contemplated. FIG. 29 is a perspective view of a headform with basic, coronal and midsagittal planes. FIG. 30 is a perspective view of a test headform with basic, coronal and midsagittal planes.

As with the first embodiment, the actuation mechanism 121 as a dial mechanism 176 is configured to selectively shorten and lengthen the lace 178 such that actuating the dial mechanism 176 adjusts portions of the rigid plates 114 around the headband region 122 to move closer to, and farther away from the skull thereby adjusting the circumference of the assembly of multiple rigid plates 114 as well as an interior volume of space where the skull sits adjacent to the assembly of multiple rigid plates 114. As such, this embodiment of the headborne attachment platform 110 may be used without a chinstrap.

The rigid plates 114 are independently and sufficiently rigid to support and maintain their three-dimensional shape when subjected to forces exerted upon them by a headborne device attached to any of the headborne device mounting features 180, 181 and 182. The rigid plates 114 include attachment features 115 configured to provide for the attachment and detachment of the straps 116 of connecting material so that the rigid plates 114 are coupled together in the assembly and can be independently adjusted and set to selectable distances apart from each other using the straps 116 of connecting material. For example, the attachment features 115 may include fasteners (e.g. screws or rivets), that are attached to the rigid plates 114 as well as the straps 116 of connecting material and used for their adjustment, attachment, and detachment to the rigid plates 114. For example, a strap dial mechanism 117 may be included on the rear rigid plate 170 to loosen, tighten and adjust the strap 116 between the rear rigid plate 170 and the top rigid plate 150.

As described, the assembly of multiple rigid plates 114 is shaped and connected by the straps 116 of connecting material such that the assembly can provide all of its functionality without being attached to an outer helmet shell.

The present invention has been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claimed invention. Further, the boundaries of these functional building blocks have been arbitrarily defined for convenience of description. Alternate boundaries could be defined as long as the certain significant functions are appropriately performed. Similarly, flow diagram blocks may also have been arbitrarily defined herein to illustrate certain significant functionality. To the extent used, the flow diagram block boundaries and sequence could have been defined otherwise and still perform the certain significant functionality. Such alternate definitions of both functional building blocks and flow diagram blocks and sequences are thus within the scope and spirit of the claimed invention. One of average skill in the art will also recognize that the functional building blocks, and other illustrative blocks, modules and components herein, can be implemented as illustrated or by discrete components, application specific integrated circuits, processors executing appropriate software and the like or any combination thereof.

The present invention may have also been described, at least in part, in terms of one or more embodiments. An embodiment of the present invention is used herein to illustrate the present invention, an aspect thereof, a feature thereof, a concept thereof, and/or an example thereof. A physical embodiment of an apparatus, an article of manufacture, a machine, and/or of a process that embodies the present invention may include one or more of the aspects, features, concepts, examples, etc. described with reference to one or more of the embodiments discussed herein. Further, from figure to figure, the embodiments may incorporate the same or similarly named functions, steps, modules, etc. that may use the same or different reference numbers and, as such, the functions, steps, modules, etc. may be the same or similar functions, steps, modules, etc. or different ones.

The above description provides specific details, such as material types and processing conditions to provide a thorough description of example embodiments. However, a person of ordinary skill in the art would understand that the embodiments may be practiced without using these specific details.

Some of the illustrative aspects of the present invention may be advantageous in solving the problems herein described and other problems not discussed which are discoverable by a skilled artisan. While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced items. Thus, the scope of the invention should be determined by the appended claims and their legal equivalents, and not by the examples given.

The invention claimed is:

1. A headborne attachment platform to be worn on, and protect, a skull of a wearer, the headborne attachment platform comprising:

multiple rigid plates respectively contoured to sit adjacent to frontal, temporal, parietal, and occipital bone regions of the skull of the wearer;

straps of connecting material connecting the multiple rigid plates in an assembly, and having a thickness that is less than a width;

a tightening mechanism associated with the assembly of multiple rigid plates;

the assembly of multiple rigid plates being shaped and connected by the straps of connecting material to sit adjacent to, and surround, the portions of the frontal, temporal, parietal, and occipital bone regions of the skull of the wearer, and defining an overall headgear shape and contour, and defining a headband region around the skull;

the straps of connecting material being more flexible than the rigid plates in directions perpendicular to the thickness of the straps;

the straps of connecting material being inelastic in a direction of a length thereof;

the tightening mechanism configured to adjust a circumference of the headband region of the assembly of multiple rigid plates;

the rigid plates having mounting features configured to mount at least one of an outer helmet shell and a headborne device;

the rigid plates being independently and sufficiently rigid to support and maintain their three-dimensional shape when subjected to forces exerted upon them by the outer helmet shell or headborne device; and the rigid plates including attachment features configured to provide for the attachment and detachment of the straps of connecting material so that the rigid plates are coupled together in the assembly and can be independently adjusted and set to selectable distances apart from each other using the straps of connecting material.

2. The headborne attachment platform according to claim 1, wherein one of the multiple rigid plates is a frontal rigid plate with a central portion to sit adjacent to the frontal bone region of the skull and opposing side portions to sit adjacent the temporal bone regions of the skull; and wherein the central portion is relatively less flexible in directions toward and away from the skull than the side portions.

3. The headborne attachment platform according to claim 2, wherein the central portion of the frontal plate has a hemispherical shape that is less flexible in the direction that would increase or decrease a radius of its shape relative to rotation about an axis between basic and coronal planes of the skull than it is flexible in the direction that would increase or decrease the radius of its shape relative to rotation about an axis between the basic and midsagittal planes of the skull.

4. The headborne attachment platform according to claim 2, wherein the side portions of the frontal plate have flexibility inward and outward in a direction towards each other, the skull, and a midsagittal plane of a headform.

5. The headborne attachment platform according to claim 1, wherein one of the multiple rigid plates is a rear rigid plate to sit adjacent the parietal and occipital bone regions of the skull; and wherein the tightening mechanism includes an actuation mechanism carried by the rear rigid plate and configured to selectively cause the frontal rigid plate to move closer to the rear rigid plate in an area surrounding the headband region of the assembly, thereby adjusting the circumference, tension, and pressure exerted upon the skull by the headband region of the assembly for fitting purposes.

6. The headborne attachment platform according to claim 5, wherein the rear rigid plate includes chinstrap attachment features to provide for attachment of a chinstrap that extends around at least one of a neck area and chin area of the wearer, and the chinstrap attachment features comprising at least one tool-less releasable buckle receiver adjacent the actuation mechanism.

7. The headborne attachment platform according to claim 5, wherein the actuation mechanism comprises a dial actuation mechanism and associated lace arranged through lace coupling features on the rear rigid plate that extend to the frontal rigid plate and configured to surround the portions of the frontal, temporal, and parietal bone regions of the skull of the wearer; wherein the dial mechanism is configured to selectively shorten and lengthen the lace such that actuating the dial actuation mechanism adjusts portions of the rigid plates around the headband region to move closer to, and farther away from the skull thereby adjusting the circumference of the assembly of multiple rigid plates as well as an interior volume of space where the skull sits adjacent to the assembly of multiple rigid plates.

8. The headborne attachment platform according to claim 5, wherein the actuation mechanism comprises at least one of a worm gear mechanism, a rack and pinion mechanism, and a spool and lace winding mechanism.

9. The headborne attachment platform according to claim 1, wherein the rigid plates include padding attachment features to provide for attachment of comfort padding materials on a side that is adjacent to the skull of the wearer.

10. The headborne attachment platform according to claim 1, wherein at least one of the straps of connecting material is defined by a reduced width portion of one of the rigid plates, such that the connection material is inelastic and only flexible in the directions toward and away from the skull.

11. A headborne attachment platform to be worn on, and protect, a skull of a wearer, the headborne attachment platform comprising:

multiple rigid plates respectively contoured to sit adjacent to frontal, temporal, parietal, and occipital bone regions of the skull of the wearer;

straps of connecting material connecting the multiple rigid plates in an assembly, and having a thickness that is less than a width;

a tightening mechanism associated with the assembly of multiple rigid plates;

the assembly of multiple rigid plates being shaped and connected by the straps of connecting material to sit adjacent to, and surround, the portions of the frontal, temporal, parietal, and occipital bone regions of the skull of the wearer, and defining an overall headgear shape and contour, and defining a headband region around the skull;

the straps of connecting material being more flexible than the rigid plates in directions perpendicular to the thickness of the straps;

the straps of connecting material being inelastic in a direction of a length thereof;

the tightening mechanism configured to adjust a circumference of the headband region of the assembly of multiple rigid plates;

the rigid plates having mounting features configured to mount at least one of an outer helmet shell and a headborne device;

the rigid plates being independently and sufficiently rigid to support and maintain their three-dimensional shape when subjected to forces exerted upon them by the outer helmet shell or headborne device;

the rigid plates including attachment features configured to provide for the attachment and detachment of the straps of connecting material so that the rigid plates are coupled together in the assembly and can be independently adjusted and set to selectable distances apart from each other using the straps of connecting material;

one of the multiple rigid plates being a frontal rigid plate with a central portion to sit adjacent to the frontal bone region of the skull and opposing side portions to sit adjacent the temporal bone regions of the skull, with the central portion being relatively less flexible in directions toward and away from the skull than the side portions;

one of the multiple rigid plates being a rear rigid plate to sit adjacent the parietal and occipital bone regions of the skull;

the tightening mechanism including an actuation mechanism carried by the rear rigid plate and configured to selectively cause the frontal rigid plate to move closer to the rear rigid plate in an area surrounding the headband region of the assembly, thereby adjusting the circumference, tension, and pressure exerted upon the skull by the headband region of the assembly for fitting purposes; and the actuation mechanism comprising a dial actuation mechanism and associated lace arranged through lace coupling features on the rear rigid plate that extend to the frontal rigid plate and surround the portions of the frontal, temporal, and parietal bone regions of the skull of the wearer; wherein the dial mechanism is configured to selectively shorten and lengthen the lace such that actuating the dial actuation mechanism adjusts regions of the rigid plates around the headband region to move closer to, and farther away from the skull thereby adjusting the circumference of the assembly of multiple rigid plates as well as an interior volume of space where the skull sits adjacent to the assembly of multiple rigid plates.

12. The headborne attachment platform according to claim 11, wherein the central portion of the frontal plate has a hemispherical shape that is less flexible in the direction that would increase or decrease a radius of its shape relative to rotation about an axis between basic and coronal planes of the skull than it is flexible in the direction that would increase or decrease the radius of its shape relative to rotation about an axis between the basic and midsagittal planes of the skull.

13. The headborne attachment platform according to claim 11, wherein the side portions of the frontal plate have flexibility inward and outward in a direction towards each other, the skull, and a midsagittal plane of a headform.

14. The headborne attachment platform according to claim 11, wherein the rear rigid plate includes chinstrap attachment features to provide for attachment of a chinstrap that extends around at least one of a neck area and chin area of the wearer, the chinstrap attachment features comprising at least one tool-less releasable buckle receiver located on the rear rigid plate adjacent the actuation mechanism.

15. The headborne attachment platform according to claim 11, wherein at least one of the straps of connecting material is defined by a reduced width portion of one of the rigid plates, such that the connection material is inelastic and only flexible in the directions toward and away from the skull.

16. A headborne attachment platform to be worn on, and protect, a skull of a wearer, the headborne attachment platform comprising:

multiple rigid plates respectively contoured to sit adjacent to bone regions of the skull of the wearer;

straps of connecting material connecting the multiple rigid plates in an assembly at independently selectable and pre-set distances apart from each other, the straps having a thickness that is less than a width;

a tightening mechanism associated with the assembly of multiple rigid plates;

the assembly of multiple rigid plates being shaped and connected by the straps of connecting material to sit adjacent to, and surround, the bone regions of the skull of the wearer, and defining an overall headgear shape and contour, and defining a headband region around the skull;

the straps of connecting material being more flexible than the rigid plates in directions perpendicular to the thickness of the straps;

the straps of connecting material being inelastic in a direction of a length thereof;

the tightening mechanism configured to adjust a circumference of the headband region of the assembly of multiple rigid plates;

the rigid plates having mounting features configured to mount at least one of an outer helmet shell and a headborne device;

the rigid plates being independently and sufficiently rigid to support and maintain their three-dimensional shape when subjected to forces exerted upon them by the outer helmet shell or headborne device.

17. The headborne attachment platform according to claim 16, wherein one of the multiple rigid plates is a frontal rigid plate with a central portion to sit adjacent to the frontal bone region of the skull and opposing side portions to sit adjacent the temporal bone region of the skull; and wherein the central portion is relatively less flexible in directions toward and away from the skull than the side portions.

18. The headborne attachment platform according to claim 16, wherein one of the multiple rigid plates is a rear rigid plate to sit adjacent the parietal and occipital bone regions of the skull; and wherein the tightening mechanism includes an actuation mechanism carried by the rear rigid plate and configured to selectively cause the frontal rigid plate to move closer to the rear rigid plate in an area surrounding the headband region of the assembly, thereby adjusting the circumference, tension, and pressure exerted upon the skull by the headband region of the assembly for fitting purposes.

19. The headborne attachment platform according to claim 18, wherein the rear rigid plate includes features to provide for attachment of a chinstrap that extends around at least one of a neck area and chin area of the wearer with said chinstrap attachment features comprising at least one tool-less releasable buckle receiver adjacent the actuation mechanism.

20. The headborne attachment platform according to claim 18, wherein the actuation mechanism comprises a dial actuation mechanism and associated lace arranged through lace coupling features on the rear rigid plate that extend to the frontal rigid plate and surround the portions of the frontal, temporal, and parietal bone regions of the skull of the wearer; wherein the dial mechanism is configured to selectively shorten and lengthen the lace such that actuating the dial actuation mechanism adjusts the regions of the rigid plates around the headband region to move closer to, and farther away from the skull thereby adjusting the circumference of the assembly of multiple rigid plates as well as an interior volume of space where the skull sits adjacent to the assembly of multiple rigid plates.

* * * * *